US006729787B2

(12) United States Patent
Usami et al.

(10) Patent No.: US 6,729,787 B2
(45) Date of Patent: May 4, 2004

(54) APPLICATOR USING PRESSURIZED AIR TO AID IN DISPENSING LIQUID

(75) Inventors: Hideyuki Usami, Tokyo (JP); Katsuhiro Ueda, Tokyo (JP); Kazuma Noguchi, Tokyo (JP); Takashi Yamaya, Tokyo (JP)

(73) Assignee: Pentel Kabushiki Kaisha, Tokyo (JP)

( * ) Notice: Subject to any disclaimer, the term of this patent is extended or adjusted under 35 U.S.C. 154(b) by 59 days.

(21) Appl. No.: 10/031,283

(22) PCT Filed: Apr. 18, 2001

(86) PCT No.: PCT/JP01/03298

§ 371 (c)(1),
(2), (4) Date: Nov. 27, 2001

(87) PCT Pub. No.: WO01/81100

PCT Pub. Date: Nov. 1, 2001

(65) Prior Publication Data

US 2003/0102334 A1 Jun. 5, 2003

(30) Foreign Application Priority Data

| | | |
|---|---|---|
| Apr. 25, 2000 | (JP) | 2000-124777 |
| May 11, 2000 | (JP) | 2000-138333 |
| May 29, 2000 | (JP) | 2000-159250 |
| Jun. 23, 2000 | (JP) | 2000-188668 |
| Nov. 29, 2000 | (JP) | 2000-363754 |
| Dec. 26, 2000 | (JP) | 2000-394280 |
| Jan. 29, 2001 | (JP) | 2001-020816 |
| Mar. 30, 2001 | (JP) | 2001-097846 |

(51) Int. Cl.[7] ..... B43K 7/08; B43K 7/10

(52) U.S. Cl. ..... 401/141; 401/219; 401/142; 401/171

(58) Field of Search ..... 401/141, 142, 401/171, 176, 179, 181, 219

(56) References Cited

U.S. PATENT DOCUMENTS

| | | | | | |
|---|---|---|---|---|---|
| 2,777,422 | A | * | 1/1957 | Cofield, Jr. et al. | 401/142 |
| 3,140,695 | A | * | 7/1964 | Fehling et al. | 401/141 |
| 3,234,917 | A | * | 2/1966 | Fehling et al. | 401/142 |
| 3,256,894 | A | * | 6/1966 | Sherman | 401/176 |
| 3,424,537 | A | * | 1/1969 | Henriksen | 401/142 |
| 3,495,920 | A | * | 2/1970 | Spaulding | 401/142 |
| 6,406,204 | B1 | * | 6/2002 | Omatsu et al. | 401/142 |

FOREIGN PATENT DOCUMENTS

| | | |
|---|---|---|
| JP | 51098634 | 8/1976 |
| JP | 06328890 | 11/1994 |
| JP | 08011483 | 1/1996 |
| JP | 08052981 | 2/1996 |
| JP | 08118874 | 5/1996 |

(List continued on next page.)

*Primary Examiner*—Tuan N. Nguyen
(74) *Attorney, Agent, or Firm*—Adams & Wilks

(57) ABSTRACT

An applicator has a tubular body containing a liquid to be dispensed. A non-return device is movably disposed in the tubular body rearwardly of and in contact with the liquid for preventing backflow of the liquid. A manually-displaceable piston member is displaceable in the tubular body in a forward direction for pressurizing air admitted into a chamber located in front of the piston member, and a normally closed valve communicates with the chamber and is openable by the force of the pressurized air to apply the pressurized air to the non-return device to urge the non-return device forwardly to thereby pressurize the liquid. A resilient member normally urges the piston member rearwardly to a rear stop position. An air passage communicates the chamber with the exterior of the applicator when the piston member is in the rear stop position, and the air passage is blocked by the piston member during displacement of the piston member in the forward direction. The non-return device comprises one or more kinds of greases, and a float having a front portion embedded in the greases and a rear portion to which is applied the pressurized air.

24 Claims, 18 Drawing Sheets

FOREIGN PATENT DOCUMENTS

| | | |
|---|---|---|
| JP | 09315082 | 12/1997 |
| JP | 10028921 | 2/1998 |
| JP | 11165488 | 6/1999 |
| JP | 00263992 | 9/2000 |
| JP | 01150865 | 6/2001 |
| JP | 01171286 | 6/2001 |
| JP | 01171287 | 6/2001 |

* cited by examiner

APPLICATOR USING PRESSURIZED AIR TO AID IN DISPENSING LIQUID

CROSS-REFERENCE TO RELATED APPLICATIONS

This application is a U.S. national stage application of copending International Application No. PCT/JP01/03298, filed Apr. 18, 2001, claiming a priority date of Apr. 25, 2000. and published in a non-English language.

TECHNICAL FIELD

The present invention relates to a dispensing device or a liquid applicator having a compressive means for compressing a liquid chamber containing a predetermined liquid, such as cosmetic appliances including eye-liners and nail polishers, etc. and writing instruments such as ball point pens and correction devices employing a correction liquid.

BACKGROUND OF THE INVENTION

An example of the prior art liquid applicators which is shown in Japanese Pre-grant Patent Publication No. 10-28921 will be explained. In this publication, a main body containing a liquid material has, at its rear portion, a cylinder chamber which has a piston slidably. At a forward portion of the cylinder chamber, a check valve which is rearward-biased by a spring force of a coil spring is provided so that a forward portion of the check-valve constitutes a liquid container portion.

At the front end of the main body, an applicator tip is disposed and a valve body which is spring-biased in a forward direction is disposed at an applicator opening of the applicator tip.

When the piston is advanced, the cylinder chamber is compressed to release the check valve by the compression force, and the compressed air is fed into the liquid container portion, so that the liquid in the liquid container portion is compressed. In the compressed state described above, the valve body is retracted to thereby discharge the liquid.

In the prior art described above, there is an advantage that liquid application (that is, discharging of a liquid) can successfully be made even when the applicator is positioned with its application tip is positioned upward or directed upward, because the liquid is compressed. As the liquid is decreased by use, however, new air is introduced into the device, and there are cases that that the liquid is dried and, in the worse case, it is completely solidified. Further, unwanted bacteria in the air get mixed with the liquid to result in a deterioration or a change in quality of the liquid and this is unfavorable particularly when the liquid is used for cosmetics.

SUMMARY OF THE INVENTION

In view of the above, it is an object of the present invention to provide a new applicator which are free from the disadvantages that are inherent to the conventional technique described above.

In a first aspect of the present invention, there is provided an applicator comprising a tubular main shaft body containing therein a liquid, a compressive means, disposed at a rear portion of the tubular main shaft body, for compressing the liquid, a non-return device positioned at a rear portion of the liquid and movable along with a decrease of the liquid, and a valve mechanism between the non-return device and the compressive means.

In the structure described above, the non-return device can be made of a liquid material and a solid material.

Further, in the present invention, the non-return device has a large-diameter portion and a small-diameter portion.

Further, a refill is provided in the tubular main shaft body, and the refill has a liquid container tube, a tip holder press-fitted to a front portion of the liquid container tube, and a ball press-fitted to a front portion of the tip holder. Two kinds of greases are disposed at the rear end of the liquid to prevent the liquid from flowing out from a rear end of the liquid container tube. The greases can contain therein a float made of a synthetic resin.

The two kinds of greases include an aqueous (or water-soluble) grease and an oil grease.

The float can have a small-diameter portion at its front portion and a large-diameter portion at the rear portion such that small-diameter portion has a larger diameter than a minimum inner diameter of the tip holder.

In a further (second) aspect of the present invention, there is provided an applicator comprising a tubular main shaft body containing therein a liquid, a compressive means, disposed at a rear portion of the tubular main shaft body, for compressing the liquid, a non-return device positioned at a rear portion of the liquid and movable along with a decrease of the liquid, and a valve mechanism between the non-return device and the compressive means, wherein the valve mechanism is retractable and returnable to its original position so that when the valve mechanism is retracted (that is, moved backward), the compressive force is decreased or released.

In the second aspect of the invention, the valve mechanism can be formed of a rubber-like resilient material.

In a further (third) aspect of the present invention, there is provided an applicator comprising a tubular main shaft body containing therein a liquid, a compressive means, disposed at a rear portion of the tubular main shaft body, for compressing the liquid, a non-return device positioned at a rear portion of the liquid and movable along with a decrease of the liquid, and a valve mechanism at a rear portion of the non-return device so that the liquid is compressed by means of the valve mechanism.

In the third aspect of the invention, a front air space is formed at a front portion of the valve mechanism and a rear air space is formed at a rear portion of the valve mechanism, and the front air space is communicated with the rear air space by a small through-hole.

In a further (fourth) aspect of the present invention, there is provided an applicator comprising a tubular main shaft body containing therein a liquid, a compressive means, disposed at a rear portion of the tubular main shaft body, for compressing the liquid, a non-return device positioned at a rear portion of the liquid and movable along with a decrease of the liquid, and a valve mechanism between the non-return device and the compressive means, wherein the valve mechanism has a first valve device for opening/closing in the direction of the liquid and a second valve device for opening/closing in the direction of the compressive means, wherein the second valve device has a stronger closing force than the first valve device.

According to the present invention, air which is introduced from the outside is compressed by the compressive means and then the compressed air serves to compress the liquid through the non-return device.

BRIEF DESCRIPTION OF THE DRAWINGS

FIGS. 1 through 10 show a first embodiment of the invention wherein FIG. 1 is a longitudinally sectional view of an applicator according to the present invention, FIG. 2 an enlarged view of elements (that is, an engagement portion between a tip and a tip holder) shown in FIG. 1, FIG. 3 a perspective view of a float, FIG. 4 a perspective view of the element (pushing member) shown in FIG. 1 and FIG. 5 a front view of the pushing member.

FIG. 6 is a perspective view of a valve mechanism.

FIG. 7 an enlarged view of the part (the engagement between the tubular shaft body and the refill) shown in FIG. 1.

FIG. 8 is an enlarged sectional view of the valve mechanism showing the operation of the valve mechanism in a normal-compression state.

FIG. 9 is an enlarged sectional view of the valve mechanism showing the operation of the valve mechanism in an over-compression state.

FIG. 10 is a longitudinally sectional view of the applicator showing an operation of the float.

FIGS. 11 to 16 show a second embodiment of the present invention, wherein FIG. 11 is a longitudinally sectional view of the applicator, FIG. 12 is a front view of the pushing member, FIG. 13 is a transversal sectional view taken along the position of an element 17*a* in FIG. 11, and FIG. 14 is a sectional view taken along the position of an element 18 in FIG. 11.

FIG. 15 is, similar to FIG. 6, a perspective view showing a valve mechanism.

FIG. 16 is a sectional view taken along the position of an element 40.

FIGS. 17, 18A and 18B show a third embodiment of the present invention, wherein FIG. 17 is a longitudinally sectional view of the elements, FIG. 18A is a plan view of the valve mechanism and FIG. 18B is a sectional view of the valve mechanism.

FIGS. 19 to 22 show a fourth embodiment of the present invention wherein FIG. 20 is an enlarged view, FIG. 21 is a sectional view showing a modification of the float and FIG. 22 is a perspective view of the valve body.

FIGS. 25 to 30 show a seventh embodiment of the present invention wherein FIG. 25 is a longitudinally section view of the applicator, FIG. 26 shows an operation of the elements of the applicator, FIG. 27 is a longitudinally sectional view of a cam member, FIG. 28 is a bottom view of the cam member, FIG. 29 is a perspective view of a rotary member and FIG. 30 is a perspective view of a slide member.

FIGS. 31 to 33 show an eighth embodiment of the present invention wherein FIG. 31 is a longitudinally sectional view of the applicator, FIG. 32 is a perspective view of a collet member, and FIG. 33 is a longitudinally sectional view of the elements showing an operation thereof.

FIGS. 34 to 39 show a ninth embodiment of the present invention wherein FIG. 34 is a longitudinally sectional view of the applicator, FIG. 35 is a perspective view of the valve mechanism, FIG. 36 is an enlarged view of a portion "A" shown in FIG. 34, FIG. 37 is a sectional view taken along 37—37 in FIG. 34, FIG. 38 is a fragmentally perspective view of the pushing member, and FIG. 39 is a partly cut out perspective view of the rotary member shown in FIG. 34.

FIGS. 40 to 42 show a tenth embodiment of the present invention wherein FIG. 40 is a longitudinally sectional view of the applicator portion, FIG. 41 is a bottom view of the valve mechanism, and FIG. 42 is sectional view taken along line 42—42 in FIG. 40.

FIGS. 43 to 46 show an eleventh embodiment of the present invention wherein FIG. 43 is a longitudinally sectional view of the applicator, FIG. 44 is an enlarged view of a tip portion for a ball point pen, FIGS. 45 and 46 are longitudinally sectional view and front view, respectively, of the cam member shown in FIG. 43.

FIGS. 47 to 49 show a twelfth embodiment of the present invention showing a modification of the eleventh embodiment, wherein FIG. 47 is an enlarged view of the elements, and FIGS. 48 and 49 are enlarged perspective views of the valve mechanism.

FIGS. 50 to 55 show a thirteenth embodiment of the present invention illustrating a so-called side-knock (or push) type structure wherein FIG. 50 is a longitudinally sectional view, FIG. 51 is a sectional view taken along 51—51 in FIG. 50, FIG. 52 is a perspective view of a pusher, FIG. 53 is a perspective view of a slide member, and FIG. 54 is a perspective view of the slide member formed integral with the container tube.

FIGS. 56 and 57 show a thirteenth embodiment of the present invention wherein FIG. 56 is a longitudinally sectional view and FIG. 57 shows an internal structure of the element shown in FIG. 45.

DETAILED DESCRIPTION OF THE INVENTION

Figure 1:
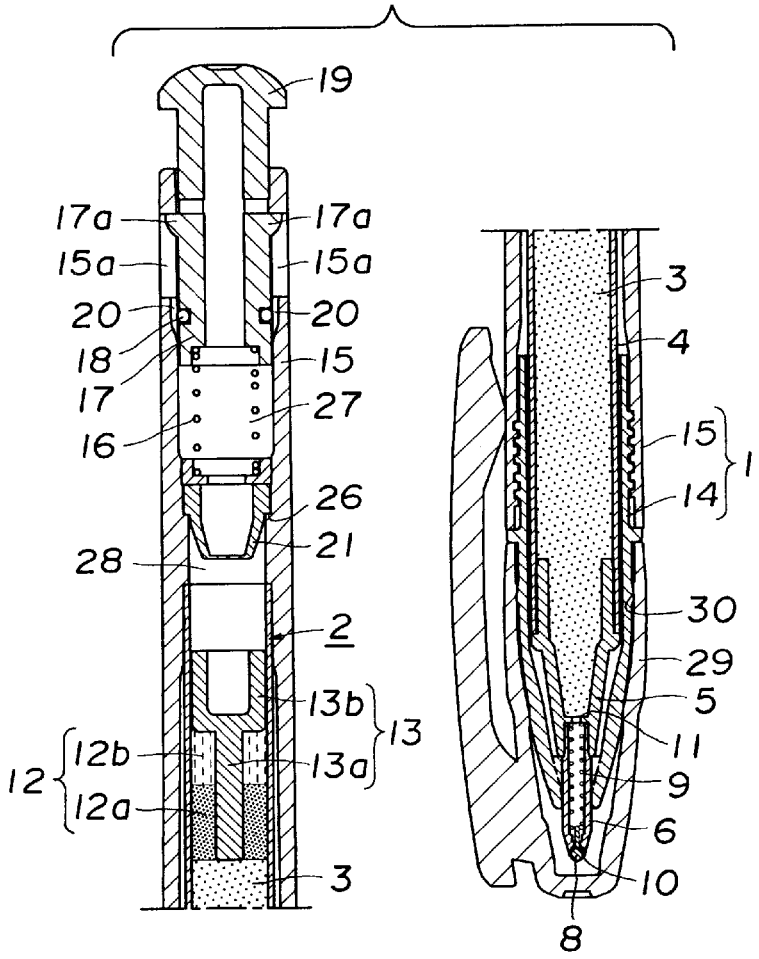
Figure 2:
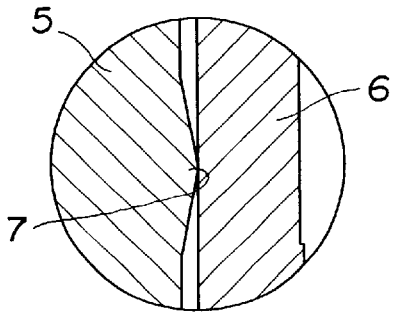
Figure 3:
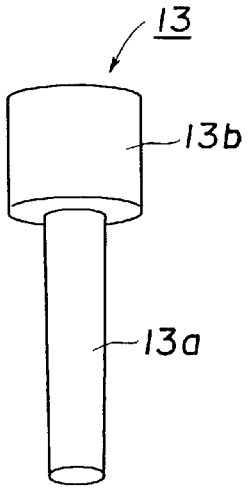
Figure 4:
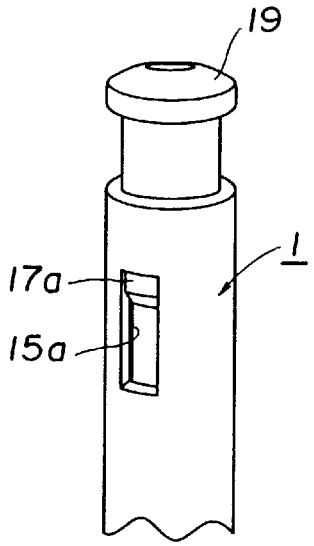
Figure 5:
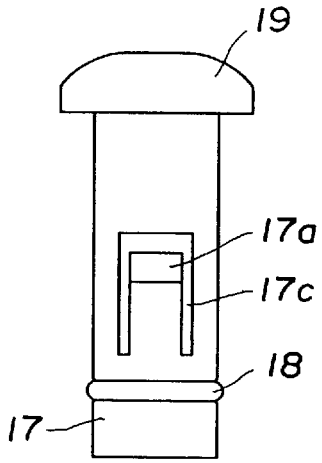
Figure 6:
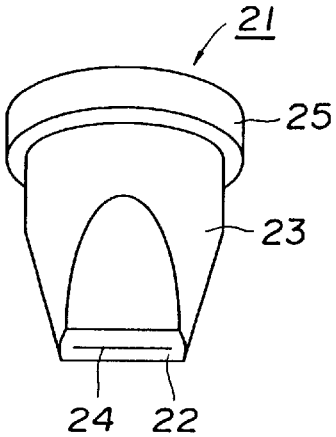

A first embodiment of the invention will be described with reference to FIGS. 1 through 10. A tubular shaft 1 has a refill 2 which comprises a liquid container tube 4 for containing therein a liquid 3, a tip holder 5 press-fitted to a front portion of the container tube 4, and a ball pen tip 6 press-fitted to a front end of the tip holder 5. The ball point pen tip 6 is press-fitted into the tip holder 5 by deforming a circumferential rib 7 formed on an inner circumferential surface of the tip holder 5. (See FIG. 2.) On the front end of the ball point pen tip 6 is provided rotatably a ball 8 which is always spring-biased forwardly by a resilient member 9 such as a coil spring and closes, in a normal condition, an opening 10 of the front end of the ball point pen tip 6. When the ball 8 of the ball point pen tip 6 is placed into contact with a coating surface, the ball 8 is retracted or moved back to open the opening 10 so that the liquid in the container tube 4 is discharged by rotary movement of the ball 8. In the illustration, reference numeral 11 represents a circumferential wall which prevents the ball point pen tip 6 from going into the tip holder 5.

At the rear end of the liquid 3, two kinds of greases 12 (that is, an aqueous grease 12*a* and an oil grease 12*b*) are provided for prevention of the liquid 3 out of the rear portion of the liquid container tube 4, and the greases 12 contain therein a float 13 of a synthetic resin. The float 13 has a small diameter portion 13*a* at its forward portion and a large diameter portion 13*b* at its rearward portion (shown in FIG. 3), and the small diameter portion 13*a* has a diameter larger than a minimum inner diameter of the tip holder 5. By sinking the float into the aqueous grease 12*a*, mobility of the aqueous grease 12*a* is restricted so that the aqueous grease 12*a* is prevented from moving upward when the applicator is placed with its tip portion facing or projecting upward. When a specific gravity of the liquid 3 is smaller than a specific gravity of the aqueous grease 12*a*, the small diameter portion 13*a* described above is not required. Further, the float 13 can be omitted if the liquid or grease used therein has a relatively high coefficient of viscosity and when the refill 2 has a relatively small inner diameter. Besides, the grease 12 can be omitted if the float 13 is contacted with an inner wall of the container tube 4 with a certain pressure. In other words, the float and greases can be selectively provided or omitted in accordance with viscosity and specific gravity of the liquid to be used as well as an inner diameter of the refill. However, it is noted that at least one of the float and the greases is provided without fail. Incidentally, the grease 12 and the float 13 will be advanced as the liquid is decreased.

If it is desirable to increase adhesiveness by a surface tension, the small diameter portion is formed into a cross shape or small undulation or uneven surface can be provided on the surface of the small diameter portion.

The shaft body 1 is divided at its forward portion into two sections to form a front shaft 14 and a rear shaft 15, and the two shafts 14, 15 are releasably coupled with each other by means of threaded engagement, press-fitting engagement or the like.

A piston member 17 which is spring-biased in the rearward direction by a resilient member 16 is slidably disposed at a rear inside of the rear shaft 15 and specifically an O-ring 18 is fitted to a middle portion of the piston member 17 to form a sliding portion relative to an inner surface of the rear shaft 15. However, instead of the O-ring 18, a circumferential projection (not shown) can be formed on an outer circumferential surface of the piston member 17.

A pushing member 19 is integrally formed on a rear portion of the piston member 17 so that the rear portion thereof is extended or projected from the rear end of the rear shaft 15. Instead of the integral or unitary structure described above, the piston member 17 and the pushing member 19 can be formed separately and then coupled together by a suitable means such as press-fitting method.

AAn air passage in the form of a lengthwise groove 20 is formed on a rear inner surface of the rear shaft 15 and the O-ring 18 of the piston member 17 is positioned at a middle portion of the lengthwise groove 20. In other words, in a normal state, the interior and exterior of the rear shaft 15 communicate with each other by the lengthwise groove.

At the rear portion of the rear shaft 15, slits 15*a* are formed at a confronting position, and resilient projections 17*a* are formed on an outer surface of the piston member 17 so that the resilient projections 17*a* are fitted to the slits 15*a*. The resilient projections 17*a* are formed by making a U-shaped slit 17*c* on the side of the piston member 17. By the fitting engagement of the resilient projections 17*a* with the slits 15*a*, the piston member 17 is prevented from releasing out of the rear shaft 15.

A valve mechanism 21 of a rubber-like resilient material is disposed at a middle portion of the rear shaft 15 and at the rear portion of the refill 2. The valve mechanism 21 has a cylindrical body 23 with a bottom of a reduced diameter and has a slit 24 at the bottom portion 22. The cylindrical body 23 has at its rear outer surface a flange portion 25 which contacts with a circumferential step portion 26 which is formed on the inner surface of the rear shaft 15, and the flange portion 25 is pushed against the circumferential step portion 26 to define the forward stop position of the valve mechanism 21 by an end portion of the resilient member 16 which spring-biases the piston member 17, so that the flange portion 25 is placed in the fixed condition relative to the rear shaft 15.

The valve mechanism 21 is formed into a cylindrical shape to have a cylindrical body 23 with a gradually reduced diameter portion (that is, tapered portion) as described above. Thus, when a pressure from the rear portion or from the direction of the cylindrical body 23, the slit 24 is readily opened, but the slit 24 is not easily opened when a reversal force (that is, a force from the front portion) is added. Namely, an area of the portion that receives a pressure is made smaller so that this portion is not readily deformed.

By providing the valve mechanism 21 at a middle portion of the rear shaft 15, two chambers are formed in the rear shaft 15. For the purpose of explanation, the chamber positioned at the rear of the valve mechanism 21 is hereinafter referred to as a pressure chamber 27 whereas the chamber formed at the forward position is referred to as pressure holding chamber 28.

A cap 29 is releasably attached to the front shaft 14 to cover the same. The cap 29 has, at its middle inner surface, a circumferential projection 30 which contacts an outer circumferential surface of the front shaft 14 so that a sealing portion is formed to seal the cap 29. In the illustrated embodiment of the invention, the sealing portion is integrally formed on the inner surface of the cap to form the circumferential projection 30, which, however, can be replaced by an O-ring or the like. However, the O-ring, if used, will possibly be dropped during an engagement-disengagement operation and, therefore, it is advisable that a unitary structure such as the circumferential projection 30 be formed on the cap so that the ball point tip is sealed.

Figure 7:
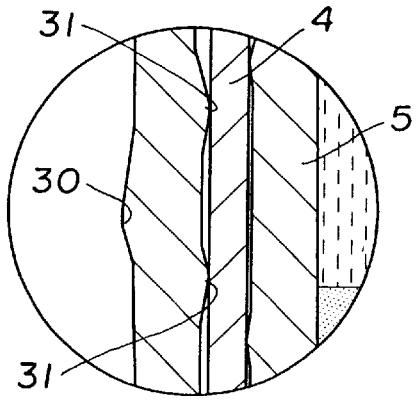

On the inner side of the position where the circumferential projection 30 is formed, a circumferential rib 31 is formed radially which can be provided at two upper and lower positions as illustrated in FIG. 7, so that the ribs hold the refill 2 (actually, container tube 4) and permit the refill 2 to be pulled out together with the front shaft 14 in a unitary manner when the refill 2 is pulled out of the shaft body 1. If desired, a circumferential rib can be formed at the front portion of the ribs 31 on the inner surface of the front shaft 14 so that the circumferential rib is placed in a close contact with the tip holder 5. This will cover the ball point pen tip 6 with a very small space so that the tip 6 is prevented from being dried up.

Specific examples for the aqueous grease 12*a* which forms the non-return device are selected from water, ethylene glycol, glycerine and so forth, and these materials can be added with thickner to improve the viscosity. Specific examples for the oil grease 12*b* can be selected from silicone, liquid paraffine, polybuten, alpha olefin and gelled or viscosity-improved by using a gelling agent or a gelling agent.

Further, the material for the valve mechanism 21 which is formed of rubber-like resilient materials can be selected from rubbers such as nitrile rubber, styrene-butadiene rubber, silicone rubber, fluororubber and butyl rubber, elastomers such as styrene-ethylene-butadiene-styrene and styrene-ethylene-propylene-styrene, and resins such as soft polyethylene, polypropylene, etc.

Further, a suitable material for the container tube 4 can be selected from metals such as stainless steel and brass, resin materials such as fluorine plastics and nylon resins. When nylon resins are used, aluminum or silicone dioxide can be deposited on its surface. Further, resins can be used with aluminum powers or glass powders being mixed in the resins.

An operation will be described with reference to FIGS. 1, 8–10. When the pushing member 19 is pushed against a resilient force of the resilient member 16, the piston member 17 is displaced forwardly from its original or rear stop position and guided by the slit 15*a* and advanced linearly.

Figure 8:
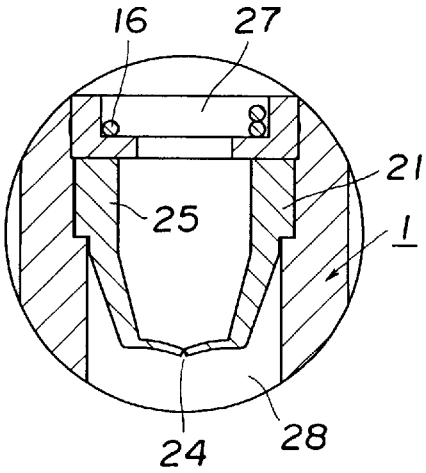
Figure 9:
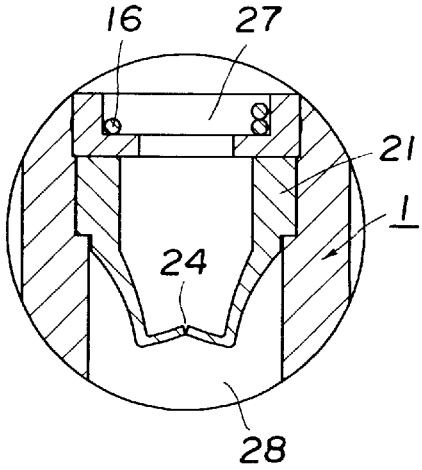
Figure 10:
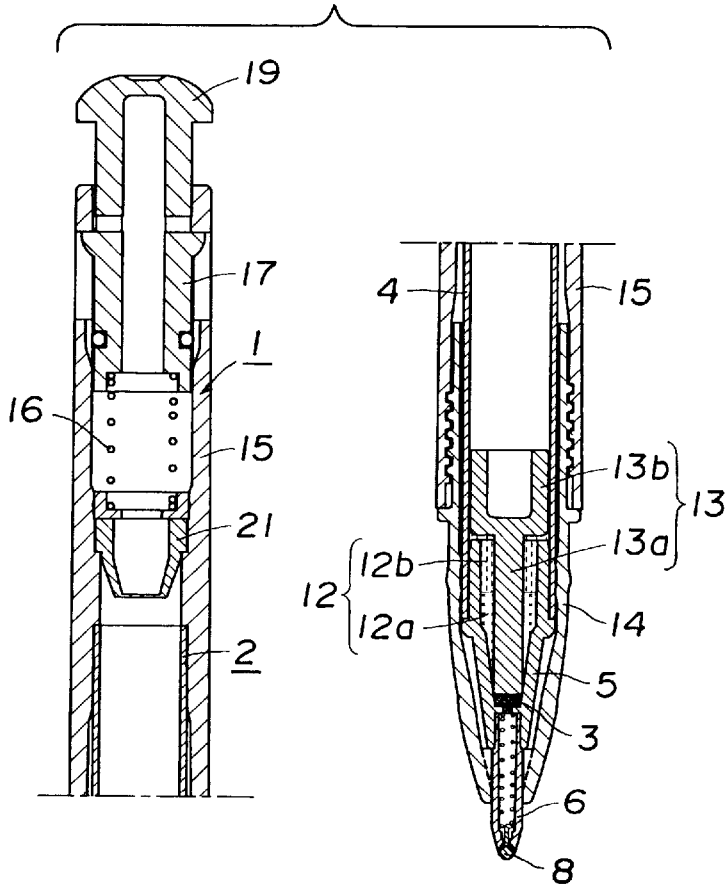

In the advancing process of the piston member 17 (i.e. displacement in the forward direction), the O-ring 18 passes along the lengthwise groove 20 together with the piston member 17 and at this moment the pressure chamber 27 starts its pressurization. When a pressure in the pressure chamber 27 is elevated to a certain point, the slit 24 of the valve mechanism 21 is dilated or opened outwardly toward the pressure holding chamber 28 as shown in FIG. 8, and the pressurized air is moved to the pressure holding chamber 28. By the movement of air into the pressure holding chamber 28, the pressure in the pressure holding chamber 28 is elevated and, consequently, the float 13 is advanced together with the grease 12 so that the liquid 3 is placed into a pressurized state. In other words, the liquid is pressurized while the float and the grease are contacted with the liquid, and it is not that the liquid is pressurized while it is contacted with the air.

When a pushing force of the pushing member 19 is released, the piston member 17 is returned by the resilient member 16 to its original, rear stop position. When the O-ring 18 of the piston member 17 travels to the lengthwise groove 20 of the rear shaft 15 in the returning process of the piston member 17, the pressure chamber 27 is communicated with the exterior so that a fresh air is introduced into the pressure chamber 27 and, consequently, the decompressed state in the pressure chamber 27 is dissolved.

In the illustrated embodiment of the invention, the piston member can be advanced (or retracted) for a predetermined distance and, therefore, the interior of the pressure holding chamber can be pressurized by a predetermined degree.

The valve mechanism 21 is made of an elastic, rubber-like resilient material, and when an excessive force or pressure is added inadvertently to the pressure holding chamber 28, the slit 24 of the valve member 21 is dilated inward after the piston member is returned (shown in FIG. 9) to release the excessive pressure back to the pressure chamber 27 and discharge the same from the lengthwise groove 20 of the rear shaft 15.

As the liquid 3 is consumed, the grease 12 and the float 13 are advanced and then the small diameter portion 13*a* of the float 14 comes into contact with an inner circumferential surface of the minimum inner diameter portion of the tip holder 5 (FIG. 10) to thereby stop the advancing movement of the float 13. In other words, the rear end of the tip holder 6 is closed so that the grease 12 is prevented from being discharged. Incidentally, if the grease is discharged after the liquid is used up, it is likely that a coating surface is soiled or contaminated by the discharged grease.

In the present invention, the applicator comprises a tubular main shaft body containing therein a liquid, a compressive means, disposed at a rear portion of the tubular main shaft body, for compressing the liquid, a non-return device positioned at a rear portion of the liquid and movable along with a decrease of the liquid, and a valve mechanism between the non-return device and the compressive means. This structure permits to keep the liquid away from the air and consequently prevents the liquid from being solidified or deteriorated.

A second embodiment of the invention will be described with reference to FIGS. 11 to 15. In the illustration, the same reference numerals represent the same or similar parts and elements. In the second embodiment, the liquid 3 is directly contained in the tubular shaft body 1 instead of provision of the refill 2 which is shown in the first embodiment of FIGS. 1 to 10, and the ball point pen tip 6 is fitted to the front portion of the shaft body 1. In the illustrated second embodiment, the ball 8 is rotatably positioned at a front end of the ball point pen tip 6 but, as explained in the first embodiment, the ball 8 can be spring-biased forwardly by the resilient member 9 such as a coil spring to close an opening 10 of the ball point pen tip 6. By placing the ball 8 of the pen tip 6 forcibly and resiliently onto the coating surface (such as a paper or the like), the ball 8 is retracted by a pushing force applied to the ball 8 to open the opening 10 so that the liquid is discharged as the rotation of the ball 8.

At the rear end of the liquid 3 is positioned a grease 12 which serves to prevent the liquid 3 from moving toward the rear portion of the tubular shaft body 1. In the grease 12 part of a float 13 of a synthetic resin is embedded. As explained in description of the first embodiment of the invention, the grease 12 and the float 13 are advanced as the liquid 3 is decreased by use.

At the rear portion of the shaft body 1, a pushing member 19 which is biased rearward by a resilient member 16 such as a coil spring is slidably positioned with its rear portion being projected. Specifically, an O-ring 18 which is made of a resilient member press-fitted to a middle portion of the pushing member 19 serves to provide a sliding portion relative to an inner surface of the shaft body 1, but it should be understood that the O-ring 18 is substituted by a circumferential projection (not shown) formed integral with the pushing member 19.

The pushing member 19 has on its side wall an engagement projection 17*a* (FIG. 12) which can resiliently be deformed and fitted movably forward and backward into an oblong hole 15*a*. Assembly is made by inwardly deforming the engagement projection 17*a* of the pushing member 19 so that the engagement projection 17*a* is fitted to the oblong hole 15*a* after the inwardly deformed engagement projection 17*a* is resiliently returned to its original position.

Figure 11:
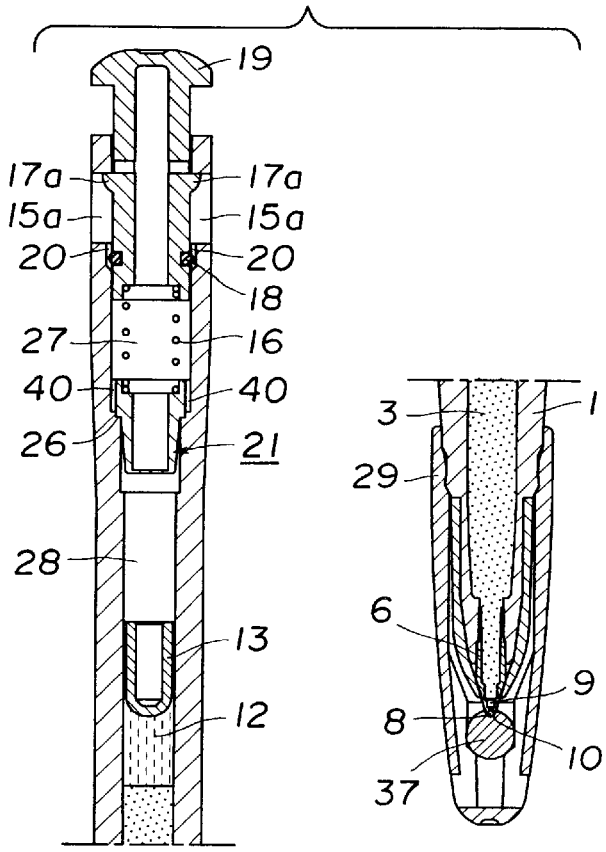
Figure 12:
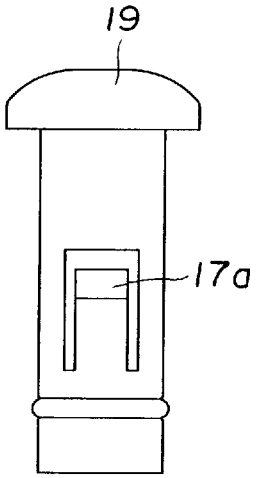
Figure 13:
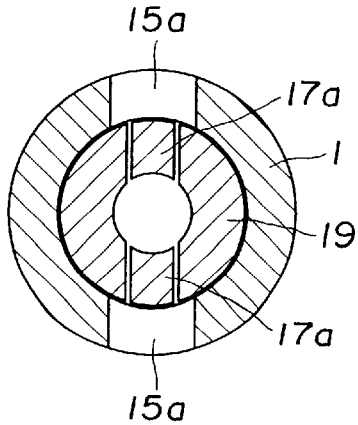
Figure 14:
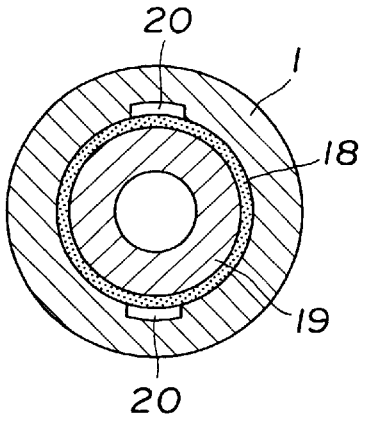

On the rear inner surface of the shaft body 1, a groove 20 is formed at the front portion of the oblong hole 15*a* and, in a normal state where the pushing member 19 is at its rearmost retracted position, the O-ring 18 of the pushing member 19 is positioned at the middle of the groove 20. In other words, in a normal state the groove 20 serves to connect the interior of the shaft body 1 with exterior of the same (FIGS. 11 and 14).

Figure 15:
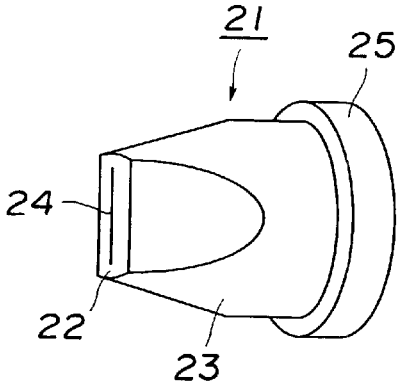
Figure 16:
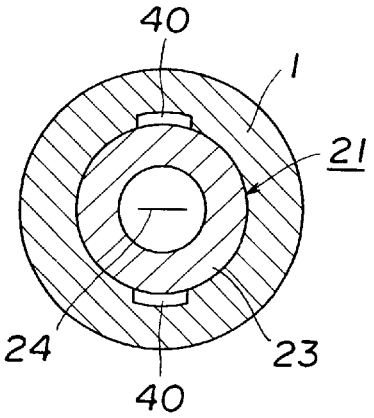

At the middle portion of the tubular body 1 is provided a valve mechanism 21 which is made of a rubber-like resilient material as shown in FIG. 15. The valve mechanism 21, similar to the first embodiment, has a tapered cylindrical body 23 having a bottom 22 with a slit 24. The cylindrical body 23 has on its outer rear surface a flange portion 25 which contacts with a circumferential step portion 26 on the inner surface of the shaft body 1 to define the forward stop position of the valve mechanism 21. The flange portion 25 of the cylindrical body 23 is pressed against the circumferential step portion 26 by the other end of the resilient member 16 which biases the pushing member 19 rearward so that the cylindrical body can be retracted (or moved backward) and returned to the original position.

The tapered tubular body 23 of the valve mechanism facilitates opening of the slit 24 when a force from the direction of the cylindrical body 23 is added, but provides some difficulty of opening when a reverse force is added. This is the same as the first embodiment of the invention. In other words, the slit 24 can be opened easily by a pressurized effect of the pushing member 19 so that the liquid 3 is prevented from being returned.

At the rear portion of the circumferential step portion 26 of the middle of the tubular shaft body 1, grooves 40 are formed in an opposed relation. The grooves can be formed in a radial direction, if desired.

By providing the valve mechanism 21 at a middle portion in the shaft body 1, two chambers are formed with a pressure chamber 27 at a rear portion of the valve mechanism 21 and a pressure holding chamber 28 at a front portion of the same, in a similar manner as the first embodiment. In FIG. 11, reference numeral 29 represents a cap member which prevents drying of the ball when the instrument is not in use, and a rubber-like packing 37 or gasket is contacted with an inner wall of the cap member 29.

The grease 12 and the valve mechanism 21 can be made of the same materials as the first embodiment of the invention.

An operation of the second embodiment will be described. When the pushing member 19 is pushed against a resilient force of the resilient member 16, the pressure chamber 27 starts to be pressurized at the stage that the O-ring 18 passes from the groove 20. When the pressure in the pressure chamber 27 is raised to a certain level, the slit 24 of the valve mechanism 21 is dilated to permit the pressurized air to be moved to the pressure holding chamber 28. By this, also the pressure in the pressure holding chamber 28 is elevated and consequently the float 3 is advanced together with the grease 12 to place the liquid 3 into a pressurized condition.

When the pressure added to the pushing member 19 is released, the slit of the valve mechanism 21 is closed so that the interior of the pressure chamber is temporarily placed into a pressure-reduction condition, but when the O-ring reaches the groove 20 of the shaft body 2, the pressure chamber is communicated with the exterior thereof and, therefore, new air is introduced into the pressure chamber. Accordingly, the above-mentioned pressure-reduction condition is canceled.

Incidentally, when an excessive pressure is added to the pressure holding chamber 28, the valve mechanism 21 is retracted against a resilient force of the resilient member 16 so that the excessive force is returned to the pressure chamber 27 and discharged out of the groove 20. Further, when an air (atmospheric) temperature rises abruptly to rapidly increase a pressure in the pressure holding chamber 28, the valve mechanism 21 is retracted to thereby eliminate or lower the excessive pressure.

A third embodiment of the invention will now be described with reference to FIG. 17 and FIGS. 17A and 17B. This embodiment shows a modification of the pushing member 19 and the valve mechanism 21.

At the rear end of the tubular shaft body 1 is fitted a bellows-like pushing member 19 which is made of an elastic, expansible rubber-like or resin materials. The pushing member 19 has, at its top end portion where user's finger will contact during operation, a through-hole 19*a*. The pushing member 19 is made of suitable soft materials such as natural rubber, butyl rubber, nitrile rubber, silicone rubber, polypropylene, polyethylene, soft elastomers.

At the middle of the shaft body 1, a planar valve mechanism 21 and valve holder 41 are positioned in a forward-biased condition by means of the resilient member 16. A forward movement of the valve mechanism 21 is restricted by a circumferential step portion 26 which is formed at a middle portion of the shaft body 1. In other words, in this embodiment as well as the previous embodiment, the valve mechanism 21 can be retracted (moved backward) against a resilient force of the resilient member 16 and returned to its former position. When the valve mechanism 21 is retracted, the pressure chamber 28 is communicated with the pressure holding chamber by means of a groove 40.

The valve mechanism 21 of this embodiment will be described. The valve mechanism 21 of this embodiment is of planar shape but is made of the similar soft materials as the previous embodiment. The valve mechanism 21 has on its outer circumference a ring portion 33 and, on its inner portion, a valve portion 35 through arch shaped connecting portions 34. On the upper surface of the valve portion 35 is provided a circumferential projection 36 which contacts a front end surface of the through-hole 41*a* of the valve holder 41. In this embodiment, coefficients of viscosity of the liquid 3 and the grease 12 are relatively high and, therefore, the float in the previous embodiment (such as the float 13 in FIGS. 1 and 11) is omitted in this embodiment. In other words, the grease only serves as the non-return device. Incidentally, examples of relatively high viscosity liquids are oily ink for ball-point pens, pastes as adhesive agents, correction liquids, and nail polisher and eye-liners as cosmetics.

An operation will be described. In the state of FIG. 17, when the pushing portion 19 is pushed with user's finger placed to close the through-hole 19*a* of the pushing portion 19, the air in the pressure chamber 27 is pressurized to thereby push the valve portion 35 of the valve mechanism 21 so that the through-hole is opened and the pressure holding chamber 28 is pressurized. By pressurizing effect of the pressure holding chamber 28, the grease 12 pushes forth the liquid 3.

When the force against the pushing member 19 is released, the valve portion 35 closes the through-hole 41*a* again and, therefore, the pressure in the pressure holding chamber 28 is maintained as it is. The returning operation of the pushing member 19 will effect a pressure reduction in the pressure chamber 27, but since the through-hole 19*a* is opened, new air is introduced into the pressure chamber 27 from the through-hole 19*a*.

Similar to the second embodiment of the invention, when the pressure in the pressure holding chamber 28 is elevated higher to an excessive point, the valve mechanism 21 is retracted against a resilient force of the resilient member 16, and the pressure chamber 27 is communicated with the pressure holding chamber 28 to thereby release the excessive pressure.

As described above, the valve mechanism is positioned such that it can be retracted (i.e., moved backward) and returned to its original position and the pressure effect is reduced or released when the valve mechanism is retracted and, therefore, the liquid is not directly exposed to or contacted with the air.

In the second and third embodiment of the invention, the liquid is contained in the tubular shaft body but the tubular shaft body can be divided into two parts at the position adjacent to the valve mechanism and the divided front portion (i.e., front shaft) is adapted to the divided rear portion (rear shaft) of the shaft body. This will permit to facilitate an easy assembly of the pressure means as well as filling of the liquid. Specifically, the liquid is filled in and the float is inserted in the front shaft, and the pressure means is fitted to the rear shaft, and the front and rear shafts are coupled together.

A fourth embodiment of the invention will be explained with reference to FIGS. 19 to 22.

Similar to the embodiment of FIG. 1, a refill 2 is disposed in the tubular shaft body 1. The refill 2 is constituted with a container tube 4 for the liquid 3 and ball point pen tip 6 which is press-fitted to a front portion of the liquid container tube 4. At the front end of the ball point pen tip 6, the ball 8 is rotatably and always biased forward by the resilient member 9 such as a coil spring to close he opening 10 of the front end of the ball point pen tip 6. By placing the applicator into an application posture in which the ball contacts a application surface, the ball 8 is retracted by the application pressure to open the opening 10, with the result that the liquid in the container tube 4 is discharged along with rotation of the ball 8.

In the rear shaft 15 of the shaft body 1, the pushing member 19 which is spring-biased rearward by the resilient member 16 is slidably disposed with its rear portion projecting but, in a specific structure, the O-ring 18 of a resilient material which is press-fitted to a middle portion of the pushing member 19 serves as a sliding portion relative to the inner surface of the rear shaft 15. The O-ring 18 can be substituted by a circumferential projection (not shown) which is integrally formed on an outer circumference of the pushing member 19.

A rear plug 42 is fitted to the rear end of the rear shaft 15 to prevent the pushing member 19 from dropping. A small gap 43 is formed between the end plug 42 and the pushing member 19.

A longitudinal groove 20 is formed on an inner rear surface of the rear shaft 15 so that the O-ring 18 of the pushing member 19 is positioned at the middle of the groove 20 in a normal condition (where the pushing member 19 is at its rearmost retracted position). In other words, in a normal condition, the interior and the exterior of the rear shaft 15 are connected with each other by the longitudinal groove 20 and the gap 43.

The valve mechanism 21 of a rubber-like resilient material is positioned at a middle portion of the rear shaft 15 and at the rear portion of the refill 2. The valve mechanism 21 is of tubular shape having a cylindrical body 23 with a bottom 22 which has a slit. A flange portion 25 is formed on an outer rear surface of the cylindrical body 23 and the flange portion 25 is contacted with the circumferential step portion 26 on the inner surface of the rear shaft and, more specifically, the flange portion is placed in an abutment relation with the circumferential step portion 26 by an end of the resilient member 16 which biases the pushing member 19, so that the flange portion 25 is in a fixed relation with the rear shaft 15.

The valve mechanism 21 of a cylindrical shape helps the slit 24 be dilated or opened easily by a pressure from the rear portion but it does not easily opened by a pressure from the opposite direction (that is, from the front portion). In order to enhance the feature and effect described above, as shown in FIG. 6 of the previous first embodiment, diameter of the cylindrical portion 23 is reduced so that the front end portion (that is, bottom portion 22) of the cylindrical body 23 is formed into a rectangular shape to reduce an area where the pressure is received. This will prevent the cylindrical portion 23 from being deformed. The valve mechanism can be made of suitable materials as described with reference to the previous embodiments and, similarly, the material for the grease 12 can be selected from those in the previous embodiments.

An operation will be described. When the pushing member 19 is actuated or pushed, pressurization in the pressure chamber 27 starts at the stage where the O-ring 18 passes the longitudinal groove 20. When the pressure in the pressure chamber 27 is elevated to a certain point, the slit 24 of the valve mechanism 21 is dilated (that is, opened) and the pressurized air is moved to the pressure holding chamber 28. By this movement of pressurized air, the pressure in the pressure holding chamber 28 is increased and consequently the float 13 is advanced together with the grease 12 to place the liquid 3 into a pressurized state.

When the force added to the pushing member 19 is released, the slit 24 of the valve mechanism 21 is closed to temporarily place the interior of the pressure chamber 27 into a decompression state. However, when the O-ring 18 of the pushing member 19 arrives at the longitudinal groove 20 of the rear shaft 15, the pressure chamber 27 is communicated with the exterior to permit the new air be introduced into the pressure chamber 27, so that the decompression state of the pressure chamber 27 is released.

In this embodiment as well as the previous ones, the valve mechanism 21 is made of a deformable, rubber-like resilient material and, therefore, even though an excessive pressure is added to the pressure holding chamber 28, the slit 24 is opened to let the excessive pressure be returned to the pressure chamber and discharged out of the longitudinal groove 20.

Figure 23:
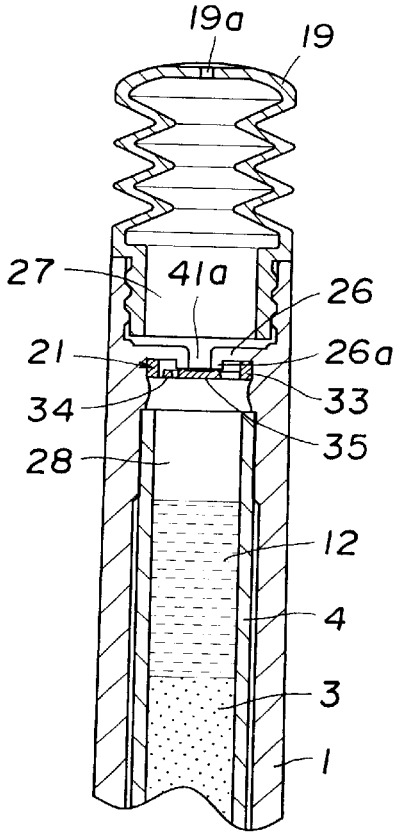
FIG. 23 is a longitudinally sectional view showing a fifth embodiment of the present invention.

FIG. 23 shows a fifth embodiment of the invention. A circumferential step portion 26 is formed on the inner rear surface of the tubular shaft body 1 and a through hole 41*a* is formed by the circumferential step portion. The through hole 41*a* has circumferential projection 36 on the end thereof, and a valve mechanism 21 is fitted on the front surface of the circumferential step portion 26 to open/close the circumferential step portion 26.

A bellows-like pushing member 19 which is expansible in its longitudinal direction is fixedly disposed at the rear end of the shaft body 1 and at the rear portion of the valve mechanism 21 by means of a suitable concave-convex engagement device. At the upper end of the bellows-like pushing member 19 is provided a hole 19*a* for introducing air. The materials for the bellows-like pushing member 19 can be selected from suitable soft materials such as natural rubber, butyl rubber, nitrile rubber, silicone rubber, polypropylene, polyethylene, soft elastomers.

The valve mechanism 21 of this embodiment is considered substantially same as that of the embodiment of FIG. 17 and the explanation will be made in simpler manner. The valve mechanism 21 is planar shaped and made of a rubber-like resilient material. Similarly to the third embodiment of FIGS. 17–18B, the valve mechanism 21 has on its outer circumference a ring portion 33 which has a valve portion 35 at the inside of the ring portion 33 through arc-shaped connectors 34. Besides, the valve portion 35 has on its upper surface a circumferential projection 36 which contacts the projection 26*a* of the circumferential step portion 26 (FIGS. 18A, 18B and 23).

In this embodiment, the liquid 3 and the grease 12 have a relatively high viscosity and, therefore, the float 13 which was used in the fourth embodiment is omitted. In other words, the grease 12 solely constitutes and serves as the non-return device. The applicator according to this fifth embodiment, is suitable for ball point pens using an oily ink, pastes and glues, correction liquids and cosmetics such as nail polisher and eye-liner.

Figure 17:
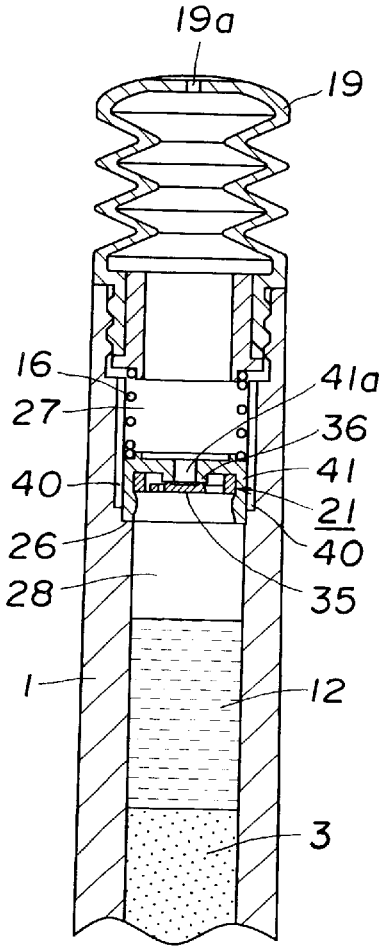
Figure 18A:
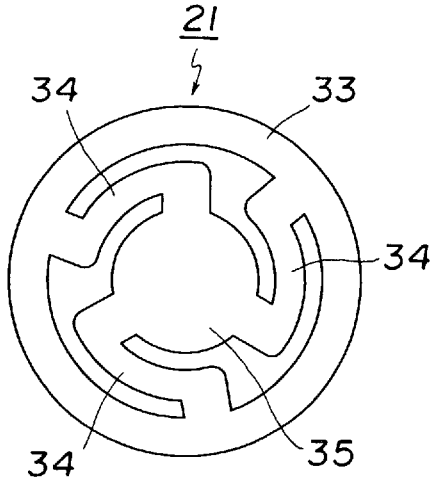
Figure 18B:
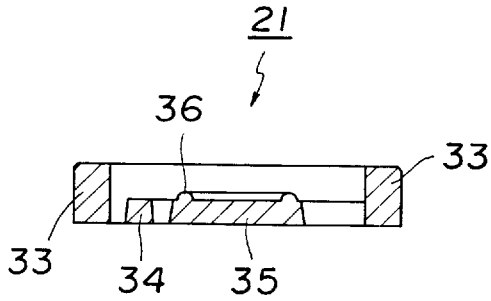
Figure 19:
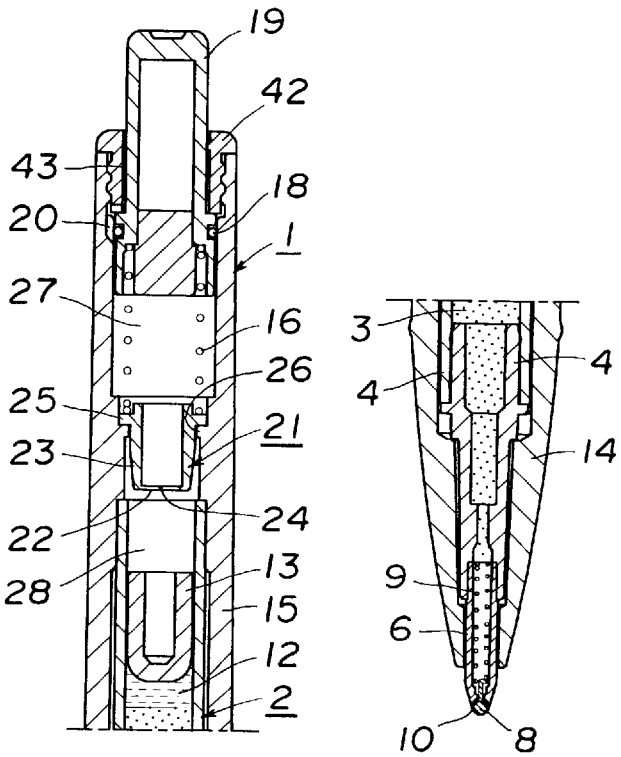
Figure 20:
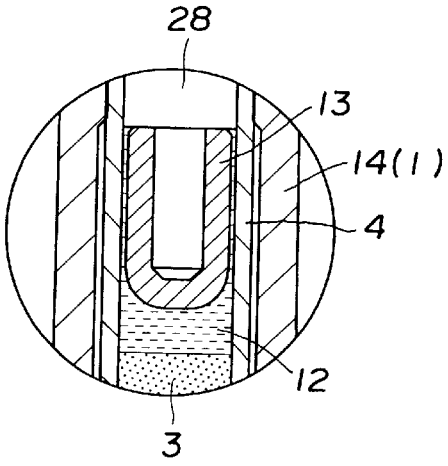
Figure 21:
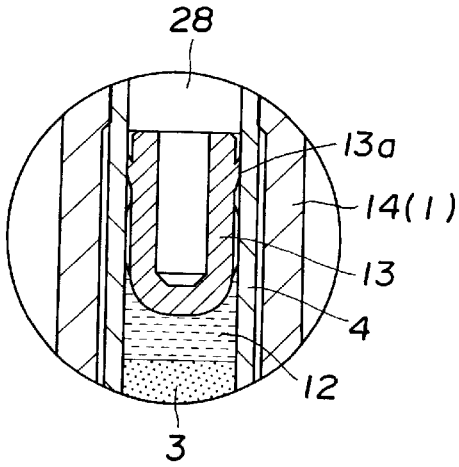
Figure 22:
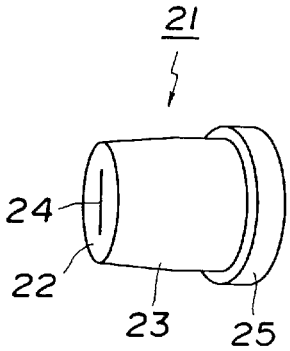

The operation of the applicator in this embodiment will be substantially same as that of the embodiment of FIGS. 17 to 18B. When the bellows-like pushing member 19 is pushed with user's finger being contacted with the through hole 19*a* to close the same, the pressure in the pressure chamber 27 is pressurized so that the valve portion 35 of the valve mechanism 21 is pushed to open the through hole 41*a* and the pressure holding chamber 28 is pressurized. Thus, the grease 12 presses forward the liquid. When the pressure added to the bellows-like pushing member 19 is released, the valve portion 35 closes again the through hole 41*a* and therefore the pressure in the pressure holding chamber 28 is maintained. With respect to the pressure chamber 27, decompression (or pressure-reduction) will possibly be made by the returning of the bellows-like pushing member 19, but a fresh air is introduced into the pressure chamber since the hole 19*a* is opened.

Figure 24:
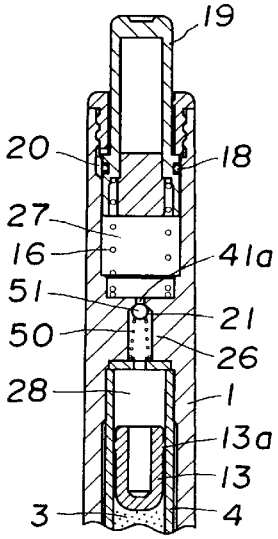
FIG. 24 is a longitudinally sectional view showing a sixth embodiment of the present invention.
Figure 25:
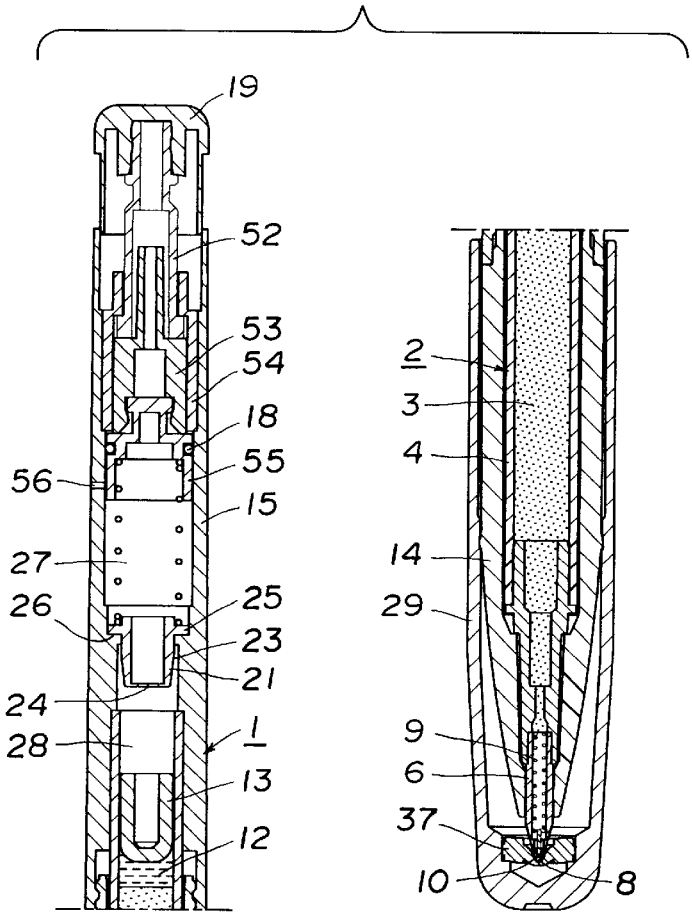
Figure 26:
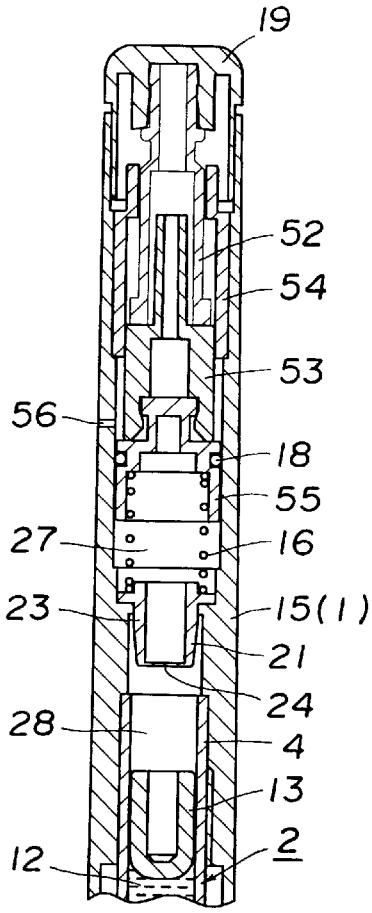
Figure 27:
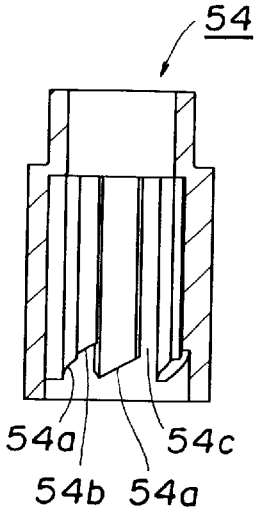
Figure 28:
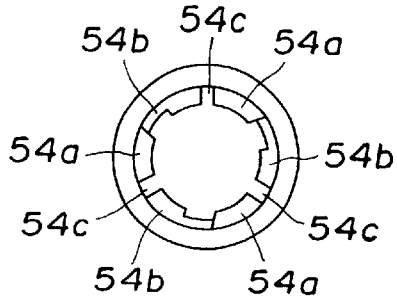
Figure 29:
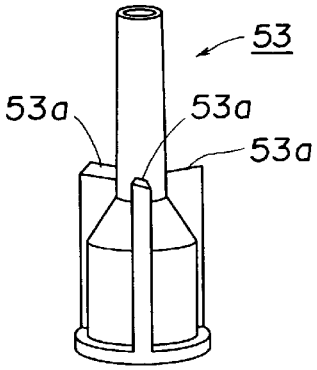
Figure 30:
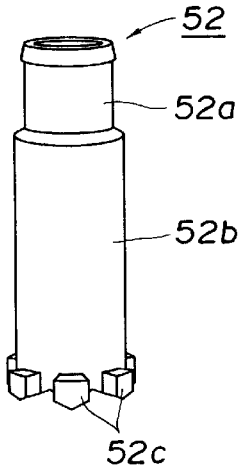

FIG. 24 shows a sixth embodiment of the invention. The circumferential step portion 26 of the inner rear portion of the tubular shaft body 1 has a through hole 41*a* and a ball 51 which is spring-biased rearward by a resilient member 50. Namely, the valve mechanism in this embodiment is a ball valve mechanism. At the rear portion of the ball valve mechanism described above and at the rear end of the shaft body 1, a pushing member 19 which is the same as that of the previous fourth embodiment of the invention is disposed in a longitudinally movable manner. The pushing member 19 is spring-biased in the rearward direction by the resilient member 16. In the illustration, reference numeral 20 represents a longitudinal groove formed at a rear portion of the tubular shaft body for the purpose of air passage in a similar manner as the previous embodiments.

In this embodiment, no grease is used and, instead, a float 13 is disposed at the rear of the liquid. The non-return device of the invention is constituted solely by the float 13 in this embodiment.

A simple description will be made with reference to the operation of the device in the sixth embodiment of the invention. When the pushing member 19 is pressed, the pressure chamber 27 is pressurized (that is, compressed), so that the ball 51 of the ball valve mechanism 21 is dropped. The compressed air is introduced into the pressure holding chamber 28 to push the float 13. When the pressure added to the pushing member 19 is released, the ball 51 closes again the through hole 41*a* and therefore the pressure in the pressure holding chamber 28 is maintained.

FIGS. 25 through 30 show a seventh embodiment of the invention. In this embodiment, the pushing member 19 provides a force to actuate the valve mechanism through a slider 52, a rotary member 53, and a pusher 55.

The cam member 54 is unrotatably fixed to the rear inner side of the rear shaft 15, and the rotary member 53 is rotatably positioned to the cam member 54 through the slider 52. The pushing member 19 is rotatably fitted to the rotary member 53. The pushing member 19 and the rotary member 53 can be made integrally. However, in order to reduce friction due to rotation of the pushing member 19 which serves as a piston relative to the inner surface of the rear shaft, it is preferred that the pushing member 19 and rotary member 53 be formed separately and then rotatably fitted together.

A rear end of the slider 52 is projected form the rear end of the rear shaft 15 and the pushing member is forcibly fitted to the projected portion of the slider 52. The pushing member 19 can be provided by extending a portion of the slider if a top of the slider 52 has a suitable, large area. The slider 52 has a small diameter portion 52*a* and a large diameter portion 52*b* as illustrated and a plurality of projections at a constant circumferential interval so that operational coupling is obtained by the engagement of the projections 52*c* with the inclined surface 53*a* of the rotary member 53.

An operation will be described. When the pushing member 19 is pushed against a resilient force of the resilient member 16, the slider 52 is advanced to move forward the rotary member 53. When the rotary member 53 arrives at its foremost advancing position, a chevron-like inclined surface 53*a* of the rotary member 53 (FIG. 29) overrides or goes beyond a chevron-like inclined surface 54*a* of the cam member 54 and goes down to, and is then engaged with, a middle step portion 54*b*. In this step, the pushing member 19 as well is pushed by the rotary member 53 and advanced, but the pushing member 19 is not rotated relative to the cam member 54 because the pushing member 19 is rotatably fitted to the rotary member 53. Accordingly, a sliding resistance of the pushing member 19 relative to the shaft body 1 is limited to, and not more than, a linear sliding resistance which is produced at the time of an advancing movement of the pushing member 19.

In the process of the advancing movement of the pushing member 19, the O-ring 18 passes through the through hole 56 and, at this very moment, compression in the pressure chamber starts. When the pressure in the pressure chamber 27 is elevated to a certain point, as similar as the previous embodiments, the slit 24 (see FIG. 6) of the valve mechanism 21 is dilated to permit the compressed air to flow into the pressure holding chamber 28. By this movement of the compressed air, a pressure in the pressure holding chamber 28 is raised and, consequently, the float 13 is advanced together with the grease 12 to place the liquid 3 into a pressurized condition. In other words, the liquid is not pressurized while it is contacted with an air, but the liquid is pressurized while it is contacted with float 13 and the grease 12.

Since the rotary member 53 maintains its engagement with the middle step portion 54*a* of the cam member 54 even after user's fingertip is released from the pushing member 19, there is no such an occurrence that the pushing member 19 is unfavorably returned to its original position by the compressed air or a spring force of the resilient member 16. Incidentally, when the pressure in the pressure chamber 27 becomes equal to the pressure in the pressure holding chamber 28, the slit 24 of the valve mechanism 21 will be closed.

In the next step, when the pushing member 19 is pushed again, the rotary member 53 is advanced by the effect of the slider 52, and the chevron-type inclined surface 53*a* or the rotary member 53 rides over and goes beyond the next chevron-type inclined surface 54*a* of the cam member 54 and then arrives at the deep groove 54*c* of the cam member 54. At this moment, the rotary member 53, along with the pushing member 19, is retracted by a spring force of the resilient member 16 and a returning force of the air in the pressure chamber 27. At this moment, the pressure chamber 27 is decompressed, and by this decompression in the pressure chamber may or may not decompress also the pressure holding chamber 28. Actually, however, the pressure in the pressure holding chamber 28 is maintained as it is because the slit 24 of the valve body 23 in the valve mechanism 21 is closed.

Further, in the returning process of the pushing member 19, the pressure chamber 27 is communicated with the exterior thereof when the O-ring 18 reaches the through hole 56 of the rear shaft 15 and, therefore, a fresh air is introduced into the pressure chamber 27 to thereby cancel the decompressed condition in the pressure chamber 27.

As described above, the pushing member 19 can be advanced (and retracted) for a predetermined distance and, therefore, a pressure which is to be added into the pressure holding chamber 28 can be added by a predetermined volume. Provided that an excessive pressure is erroneously added to the pressure holding chamber 28, the slit 24 of the valve body 23 is dilated after the returning of the pushing member 19, so that the excessive pressure is returned to the pressure chamber 27 and then discharged out of the through hole 56.

Figure 31:
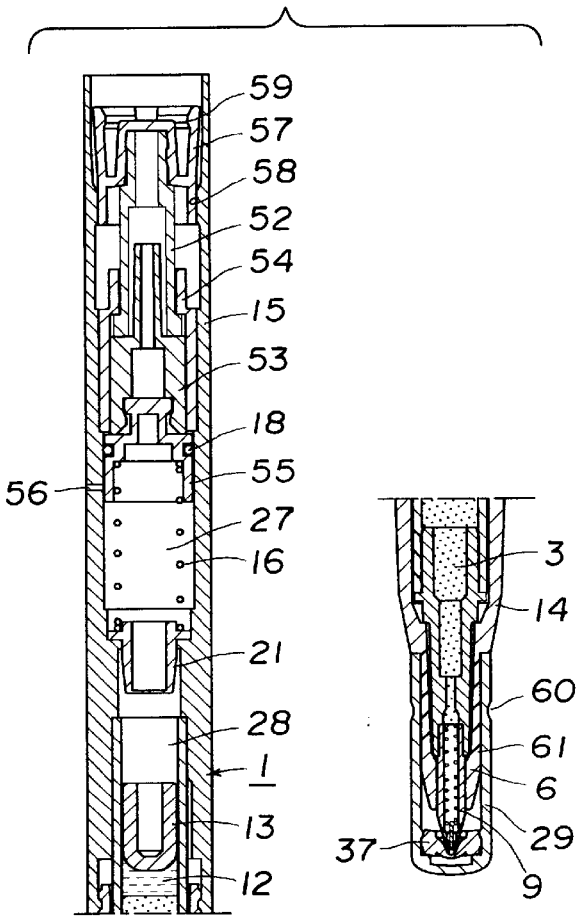
Figure 32:
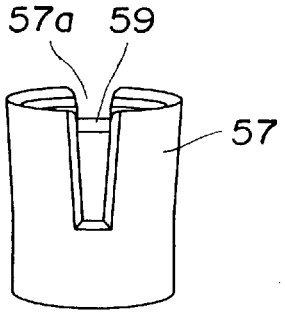
Figure 34:
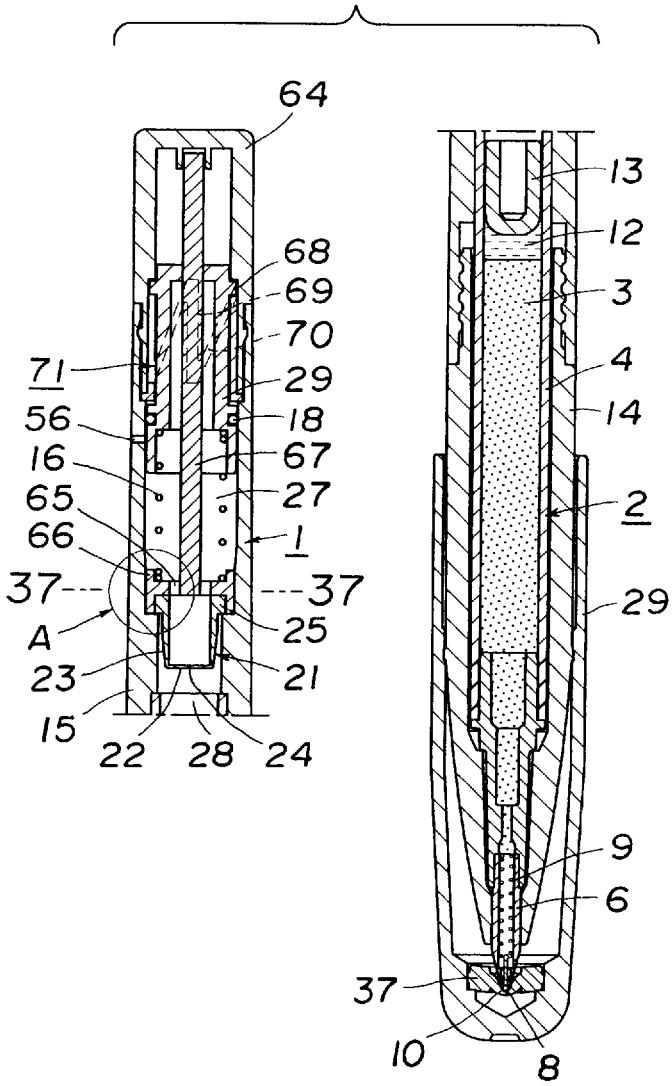
Figure 33:
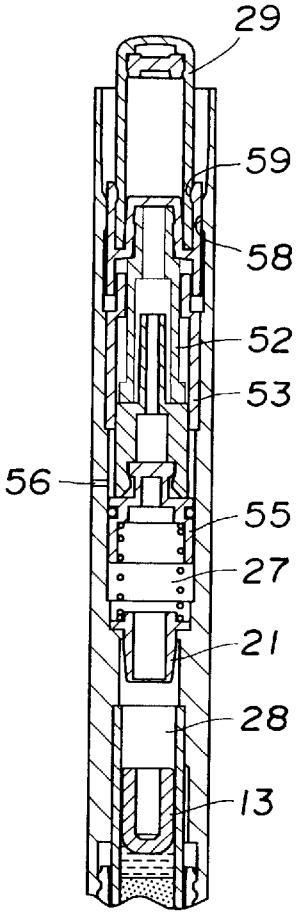
Figure 35:
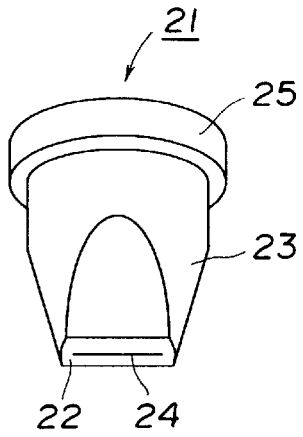
Figure 36:
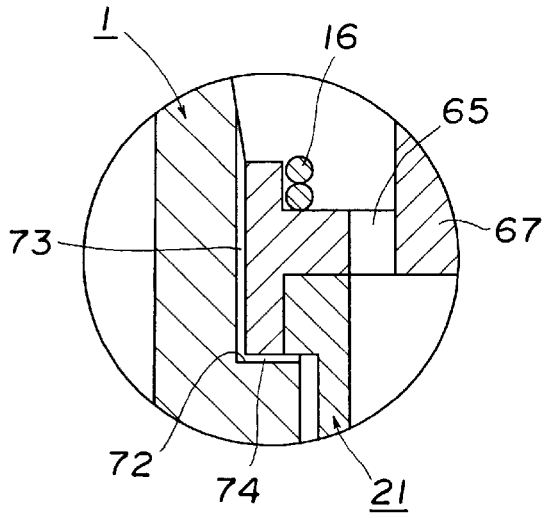
Figure 37:
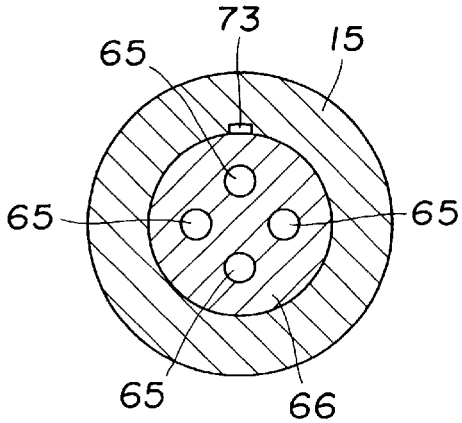

FIGS. 31 to 33 show a eighth embodiment of the invention. The front shaft 14 of the tubular shaft body 1 is reduced in its diameter at the front portion thereof to form a reduced diameter portion 61, to which a cap 29 of a small diameter is removably fitted. The cap 29 has, on its outer surface, a circumferential recess 60 which is engaged with the collet member 57 which will be described presently.

On the inner rear side of the rear shaft 15 of the tubular shaft body 1, a David cam such as the slider 52 used in the seventh embodiment of the invention is positioned, and a collet member 57 is fixed to a rear portion of the slider 52. The collet member 57 is normally opened or dilated outwardly and has a slit 57*a* so that it can be placed into a reduced-diameter posture when it contacts an inner projection 58 of the rear shaft 15. In other words, the slit 57*a* serves to elastically deform the collet member 57. The collet member 57 is of a cylindrical shape as shown in FIG. 32 and has an inner circumferential projection 59 which is engaged with a circumferential recess 60 of the cap 29. Further, the rear end of the collet member 57 is flushed with, or otherwise slightly depressed relative to, a rear end of the rear shaft 15.

An operation will be described. In the state that the cap 29 is fitted to the front shaft 15 (FIG. 31), the collet member 57 which is fixed to the slider 52 is slightly depressed into the rear shaft 15 and, accordingly, the collet 57 is not pushed. Thus, it is not possible to advance the slider 52, the rotary member 53 and the pushing member 19. Namely, it is not possible to pressurize the pressure holding chamber 28.

The cap 29 is removed from the front shaft 14 and fitted to the collet member 57. When the cap 29 is pushed to advance the collet member 57, the outer circumference of the collet member 57 is contacted with an inner projection 59 which is formed on an inner surface of the rear shaft 15 and narrowed, so that the cap 29 and the collet 57 are releasable from each other. At the same time, the slider 52, the rotary member 53 and the pusher 55 fitted to the rotary member 53 are advanced in a similar manner as the seventh embodiment, so that the pressure holding chamber 28 is pressurized.

In this state, only a small portion of the top of the cap 29 is projected from the rear end of the rear shaft 15 and, therefore, it is difficult to remove the cap 29 from the collet member 57 in view of the engagement between the cap 29 and the collet member 57. Projection degree of the cap 29 can be selectively determined so that an engagement between the rotary member 53 and the cam member can be released. More specifically, it is sufficient that the cap 29 is projected by approximately 5 mm.

After the use of the applicator, when the cap 29 is pushed again, the cap 29 is returned by a recovering force of the resilient member 16 and projected again from the rear shaft 15 to its original position. At this moment, the collet member 57 is dilated to loosen the engagement and, consequently, the cap can be released from the collet member 57. Besides, the slider 52 and the pushing member 55 are in their recovered state so that the pressure in the pressure chamber 27 is released. Namely, in this embodiment of the invention, inadvertent pressurization while the applicator is not in use and continued pressurization after the use of the applicator are prevented.

FIGS. 34 to 39 show a ninth embodiment of the invention. A refill 2 is disposed in the tubular shaft body 1. A container tube 4 for the liquid 3 and the refill 2 having a ball pen tip 6 are provided and the structure of these elements as well as their operation are substantially same as those of the previous embodiments such as the first embodiment shown in FIG. 1 and, therefore, the description will be omitted for simplification only.

At the rear end of the liquid 3 is disposed a grease 12 with a float 13 of a synthetic resin embedded therein. This structure is the same as the previous embodiments and no further description is made.

The tubular shaft body 1 is consisted with a front shaft 14 and a rear shaft 15 which are releasably connected together by means of threaded engagement or any other suitable coupling means. In this embodiment, the rear shaft 15 has, at its rear end, a rotating member 64 of a tubular shape with a bottom end. The rear shaft 15 has, on its side surface of its rear portion, a small hole 56.

A valve mechanism 21 of a rubber-like resilient material is disposed at a rear portion of the container tuber 4 of the refill 2 and on the inner surface of the middle portion of the rear shaft 15. The valve mechanism 21 is of a cylindrical shape with a bottom portion 22 with a reduced diameter as similar as the first embodiment shown in FIG. 6. The bottom portion 22 has a slit 24 (see FIG. 6). The cylindrical valve mechanism 21 has, on its rear outer surface, a flange portion 25 which is engaged with a step portion 72 of the rear shaft 15.

The valve mechanism, similar to the previous embodiments, has a cylindrical body 23 which is tapered gradually so that the slit 24 is easily opened or dilated by a force from the rearward but not easily opened by a force in the opposite direction (that is, a force from the forward).

A valve holder 66 is disposed at the rear portion of the valve mechanism 21, and the valve mechanism 21 is strongly press-fitted to the inner surface of the rear shaft 15 so that the valve mechanism 21 is immovable to the rear shaft 15. The valve holder 66 has a plurality of radial through holes (four holes in the illustrated embodiment) 65 for feeding the air into the valve mechanism 21.

On the inner surface of the rear shaft 15, which is correspondent with the position of the valve holder 66, a small longitudinal groove 73 is provided. A lateral groove 74 which extends continuously from the longitudinal groove 73 is formed on the step portion 72. This means that the pressure chamber 27 is communicated with the pressure holding chamber 28 through the small longitudinal groove 73 and the lateral groove 74.

The valve holder 66 has an extended portion having a cross shape in cross section, and a pushing member 29 which is spring-biased rearward by the resilient member 16 is unrotatably and longitudinally movably engaged with the extended portion 67. In other words, the pushing member 29 has an engagement hole 75 of a cross shape and the extended portion 67 is inserted through the engagement hole 75 to establish an engagement. In the illustration, reference numeral 18 represents an O-ring of a rubber-like elastic material which is fitted around the pushing member 29 and slidably contacted with an inner wall of the rear shaft 15.

Figure 38:
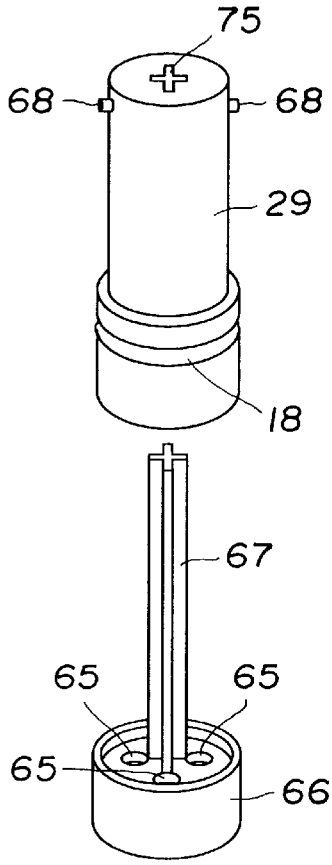
Figure 39:
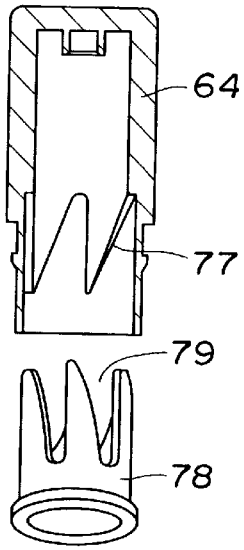

As shown in FIG. 38, two projections 68 are formed in an opposed relation with each other on the pushing member 29 so that they are engaged with a chevron type groove 71 (FIG. 34) formed in the rotating member 64.

The chevron type groove 71 will be described. The groove 71 is formed by combination of a chevron type step portion 77 on the inner surface of the rotating member 64 and an auxiliary member 78 having a chevron type cut-out portion 79. It is difficult to form the groove 71 on the inner surface of the rotating member 64 by an injection molding method and, therefore, two parts are made initially and then combined together to form the groove 71.

The groove 71 is formed by providing a linear groove 69 and an inclined groove 70 in an alternate relation.

Reference numeral 29 (FIG. 34) is a cap which is substantially same as that of the previous embodiment and releasably attached to the front shaft 14. The cap 29 has an inner portion which contacts a ball 8 and has a rubber-like gasket 37 for closing an opening 10.

The grease 12 and the valve mechanism 21 can be made of suitable materials described in the previous embodiments.

An operation will be described. When the rotating member 64 is rotated, the pushing member 29 which is engaged with the extended portion 67 is not allowed to be rotated. However, since the projection 68 of the pushing member 64 is engaged with the chevron type groove 71 of the rotating member 64, the pushing member 29 is advanced along the groove 71. More specifically, when the rotating member 64 is rotated in a clockwise direction, the projection 68 (pushing member 29) is advanced along the inclined groove 70 against a spring force of the resilient member 16. In the advancing process of the pushing member 29, the O-ring 18 of the pushing member 29 passes through the through hole 56 of the rear shaft 15 and at this moment pressurization of the pressure chamber 27 starts. When the pressure in the pressure chamber 27 is elevated to a certain point, the slit 24 of the valve mechanism 21 is dilated and the pressurized air is moved to the pressure holding chamber 28. By this movement of the air, the pressure in the pressure holding chamber 28 is raised and, consequently, the float 13 is advanced together with the grease 12 to place the liquid 3 into a pressurized stated. In other words, it is not that the liquid 3 is pressurized while the liquid 3 is contacted with air, but the liquid 3 is pressurized while the float 13 and the grease 12 are in contact with the liquid. When the pressure in the pressure chamber 27 becomes equal to the pressure in the pressure holding chamber 28, the slit 24 of the valve mechanism 21 is closed.

When the projections 68 of the pushing member 29 reaches the front end of the groove 70, the projections 68 are located in the linear groove 69 and, consequently, the pushing member 29 is retracted at one stroke by a resilient force of the resilient member 16 as well as a recovery force of the air in the pressure chamber 27. At this moment, the pressure chamber 27 is decompressed, but the pressure holding chamber is not decompressed but it maintains its pressure because the slit 24 of the valve mechanism 21 is closed.

When the O-ring 18 reaches the through hole 56 of the rear shaft 15 in the returning or recovery process of the pushing member 29, the pressure chamber 27 is communicated with the exterior and, therefore, a fresh air is introduced into the pressure chamber, so that the decompression state in the pressure chamber is cancelled or released.

After the pushing member 29 is returned to the original position where the pressure holding chamber 28 is communicated with the pressure chamber 27 by means of the small lateral groove 74 and the longitudinal groove and, therefore, the pressurized air in the pressure holding chamber 28 is gradually discharged from the through hole 56 by way of the lateral groove 74 and the longitudinal groove 74. Further, the valve mechanism 21 is made of a rubber-like elastic material so that it can be deformed, and when an excessive pressure is added to the pressure holding chamber 28, the pressurized air will dilate or open the slit 24 of the valve mechanism 21 after the pushing member 29 is returned, so that the excessive pressure is returned to the pressure chamber 27 and then discharged out of the through hole 56.

Figure 40:
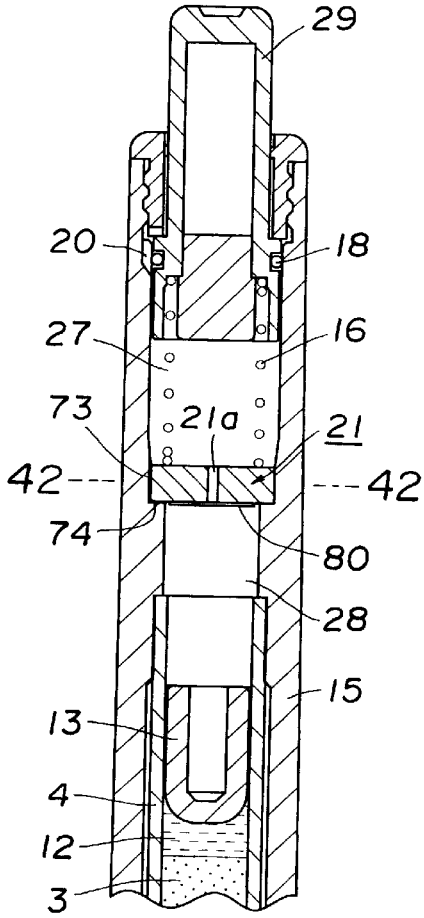
Figure 41:
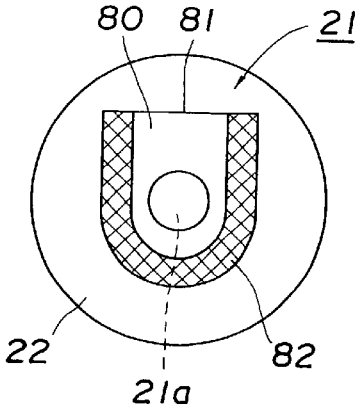
Figure 42:
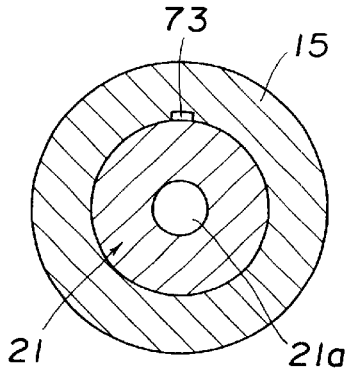

FIGS. 40 to 42 shown a tenth embodiment of the invention which is a modification of the ninth embodiment described above. For the purpose of simplification only, description of the structure and elements that are similar with those of the ninth embodiment will be omitted. In the tenth embodiment, a valve mechanism 21 has a film-like valve member 89. Specifically, a valve mechanism 21 is fixed to a middle portion of the rear shaft 15 and has a through hole 21*a* at the central portion thereof. A film member 80 of a suitable material such as polyethylene is adhered or heat-adhered to the bottom surface 22 to close the through hole 21*a* to form an adhesive portion 82 having a non-adhesive portion so that the non-adhesive portion serves as an inlet 81 for the pressurized air.

The pushing member 29 is longitudinally slidably disposed at the rear end of the rear shaft 15, and the O-ring 16 which slidably contacts the inner surface of the rear shaft 15 is provided at a front portion of the pushing member 29. Namely, the resilient member 16 is provided between the pushing member 29 and the valve mechanism 21 to spring-bias the pushing member 29 rearward. Reference 20 represents a groove which communicates the pressure chamber 27 with the exterior, and reference numerals 73 and 74 are a longitudinal groove and a lateral groove which serve to communicate the pressure chamber 27 and the pressure holding chamber 28 together.

An operation of the tenth embodiment will be described. When the pushing member 29 is pushed, the air in the pressure chamber 27 is compressed to open the inlet 81 of the film member 28, so that the pressure holding chamber 28 is also pressurized and the liquid 3 is pressurized, too. Incidentally, when the pushing force added to the pushing member 29 is released, the pushing member 29 is retracted by a spring force of the resilient member 16, and the air inlet 81 of the film member 80 is closed by its own recovery force and the pressure in the pressure holding chamber 28. Immediately before the pushing member 29 is completely returned, the pressure chamber 27 is communicated with the exterior by means of the groove 20 so that the air flows into the pressure chamber 27.

Similar to the ninth embodiment of the invention, the pressure holding chamber 28 is communicated with the pressure chamber 27 by the small lateral groove 74 and the longitudinal groove 73 and, therefore, the pressurized air in the pressure holding chamber 28 is gradually discharged from the groove 20 through the small lateral and longitudinal holes 74, 73, respectively. As a valve mechanism, ball valve mechanism and a planar valve mechanism can be used if desired.

In all the embodiments of the invention described above in which a refill 2 is used, it is desirable that the material for the refill is selected from nylon resins because nylon resin has a benefit in resistance to solvents and therefore it can prevent expansion or "swelling" by solvents and volume reduction of the liquid to be used.

FIGS. 43 to 46 show a eleventh embodiment of the invention, in which refill 2 is disposed in the tubular shaft body 1. Structure and arrangement of the refill are substantially same as those of the previous embodiments.

Two kinds of grease 12 (that is, aqueous grease 12*a* and oily grease 12*b*) is disposed at the rear of the liquid 3 to prevent the liquid from flowing out from the rear portion of the container tube 4. In the grease 12 a float 13 of a synthetic resin is embedded which, however, can be deleted when grease 12 has a high viscosity or when an inner diameter of the refill 2 is relatively small. On the other hand, the grease 12 can be deleted in a similar manner as in the previous embodiment, when the float 13 is forcibly (with a certain pressure) contacted with the inner wall of the container tube.

The pushing member 55 which is spring-biased rearward by the resilient member 16 is slidably disposed in the rear portion of the rear shaft 15 and, specifically and actually, the O-ring 16 of a resilient material is press-fitted to the middle portion of the pushing member 55 and serves as a sliding member which slides along an inner surface of the rear shaft 15. The O-ring 16 can be replaced by a circumferential projection (not shown) which is made on an outer circumference of the pushing member 55.

A cam member 54 (FIGS. 45 and 46) are unrotatably fixed to the rear shaft inside the rear portion of the rear shaft 15. A rotary member 53 is rotatably disposed to the cam member 54 through the slider 52. The slider 52 and the rotary member 53 are substantially same as those in the previously mentioned seventh embodiment shown in FIGS. 29 and 30. Thus, a so-called David cam (or rotary cam) is positioned inside the rear portion of the rear shaft 15. The pushing member 55 is rotatably fitted to the rotary member 53. The pushing member 55 and the rotary member 53 can be formed in a unitary structure but it is preferred that they are formed separately and then joined together in order to eliminate a frictional force between the inner surface of the rear shaft and the rotating pushing member.

The rear end of the slider 52 is projected from an end of the rear shaft 15 and the pushing member 19 is fitted to the projected portion of the slider. On the inner surface of the rear shaft 15, a longitudinal groove 20 is formed so that in case of a normal condition (that is, at the rearmost retracted position of the pushing member 19), the O-ring 16 of the pushing member 55 is positioned at the rear of the longitudinal groove 20 which serves to communicates the interior of the rear shaft 15 with the exterior of the same. The positional relationship among the elements of the longitudinal groove 20 of the rear shaft 15, the O-ring 16 and the pushing member 55 is substantially same as that of the previous embodiment and no further description will be made for avoiding redundancy.

A valve mechanism 21 of a rubber-like elastic material is disposed at the middle of the rear shaft 15, at the rear of the refill 2. The valve mechanism 21, which is same as that of the embodiment of FIGS. 1 and 15, has a bottom portion of a reduced diameter having slit 24, and a flange on an outer surface of the rear portion, so that the flange 25 is forced against the circumferential step portion 26 on the inner surface of the rear shaft 15 and placed into a fixed position relative to the rear shaft. The valve mechanism 21 is of cylindrical shape and has a tapered cylindrical body 23 and this configuration permits the slit 24 to be opened easily by a pressure added from the cylindrical body (that is, from the rear of the applicator) but does not permit the slit 24 to be opened easily by a pressure of the opposite direction. In other words, an area of the portion which receives a pressure is made smaller to make it difficult to deform that area of the portion. In a similar manner as the previous embodiments (for example, first embodiment) the valve mechanism 21 is provided at the middle of the rear shaft to form a pressure chamber 27 and a pressure holding chamber 28.

A cap 28 which is removably fitted to the front shaft 14 has an inner cap 29*a* having a slightly smaller inner diameter than an outer diameter of a ball point pen tip 6, such that the inner cap 29*a* is integrally formed inside the cap 29. In other words, the inner cap 29*a* is releasably fitted to the ball point pen tip 6 and when it is fitted in position, the ball point pen tip is placed into a sealed state. Although it is possible to provide an O-ring (not shown) of a resilient material inside the inner cap 29*a* to thereby seal the pen tip 6, it is desired that the inner cap 29*a* be integrally formed with the cap 29 to prevent the inner cap 29*a* from dropping out of the cap 29. Further, in order to ensure the sealing state of the ball point pen tip 6, it is possible to provide a circumferential projection on either an inner surface of the inner cap 29*a* or an outer surface of the pen tip 6.

Examples of the material for the grease 12 will be as same as the examples shown in the previous embodiments and selected from silicone, liquid paraffin, polybuten, alpha-olefin, etc. The material for the valve mechanism 21 can be selected from nitrile rubber, styrene-butadiene rubber, silicone rubber, fluoro-rubber, butyl rubber, etc.

The container tube 4 is preferably made of nylon as described in the eleventh embodiment of the invention and it can be selected, in accordance with composition of the liquid and the solvent to be used, from those which are treated by aluminum deposition or silicon dioxide deposition on the surface of the nylon resin, those which are formed by mixing the resin with aluminum powder or glass powder, and from metals such as stainless steel and brass, and other resin materials such as fluorine-contained resins.

An operation of the applicator in the eleventh embodiment, which will be understood from the various embodiments described above, will be described quite simply with reference to FIGS. 43 to 46 and FIGS. 29 and 30. When the pushing member 19 is pushed against a resilient force of the resilient member 16, the slider 52 is advanced and also the rotating member 53 is advanced by the slider 52. When the rotating member 53 is moved to its foremost advanced position, the chevron type inclined portion 53*a* of the rotating member 53 rides over the chevron type inclined surface 54*a* and is rotated and retracted to the groove portion 54*c*. In this step, the pushing member 55 which is spring-biased rearward by the resilient member 16 is pushed by the rotating member 53 and advanced. However, the pushing member 5 is rotatable relative to the rotating member 53 and, therefore, the pushing member 55 is not rotated relative to the cam member 54. Accordingly, a sliding resistance of the pushing member 55 relative to an inner surface of the tubular shaft body 1 is limited to, and not more than, a linear sliding resistance generated at the time of advancing movement.

Further, in the process of the advancing movement of the pushing member 55, the O-ring 16 passes through the through hole 20 and at this moment the pressurization starts in the pressure chamber 27. When the pressure in the pressure chamber 27 is elevated up to a certain point, the slit 24 of the valve mechanism 21 is opened to move the pressurized air into the pressure holding chamber 28. Thus, the pressure in the pressure holding chamber is increased, with the result that the float 13 is advanced together with the grease 12 to pressurize the liquid 3. In the present invention, the liquid is pressurized not by the contact with the air but by the contact with float 13 and the grease 12.

Incidentally, when the O-ring 16 reaches the through hole 20 in the returning process of the pushing member 55, the pressure chamber 27 is communicated with the exterior thereof and a fresh air flows into the pressure chamber 27 to cancel the decompressed condition of the pressure chamber 27. Accordingly, the pushing member 55 can be advanced (and retracted) by a predetermined distance and, therefore, the pressurization of the pressure holding chamber can be made by a predetermined volume. Further, the valve mechanism 21 is made of a rubber-like elastic material and therefore when an excessive pressure is added to the pressure holding chamber 28, the slit 24 of the valve mechanism 21 is opened after the pushing member 55 is returned to its original position, so that the excessive pressure can be sent back to the pressure chamber 27 to discharge it out of the through hole 20.

Figure 43:
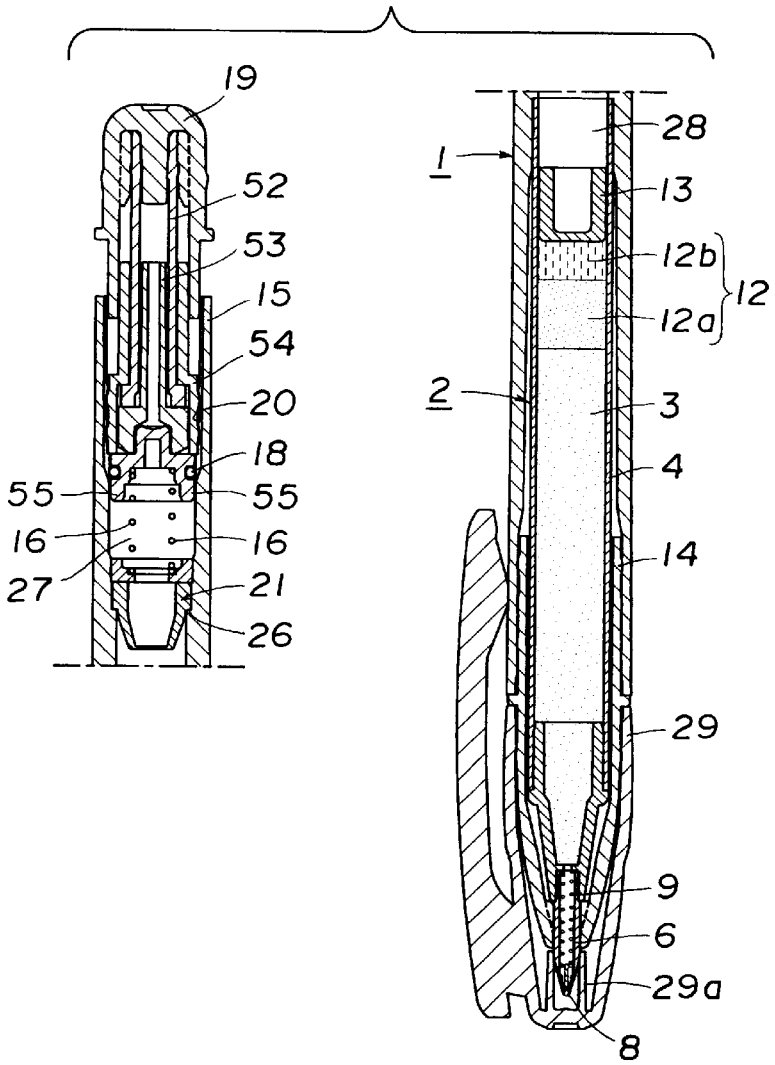
Figure 44:
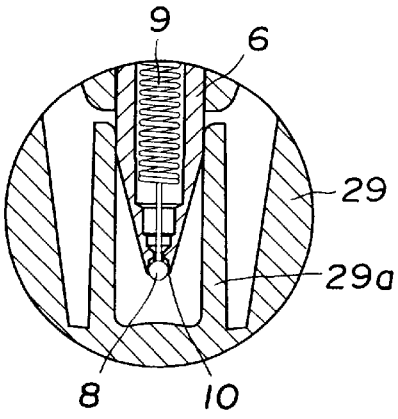
Figure 45:
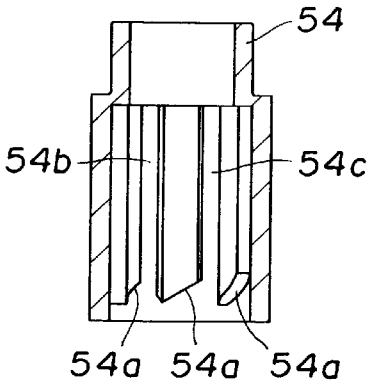
Figure 46:
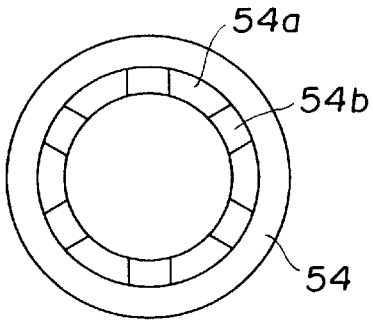
Figure 47:
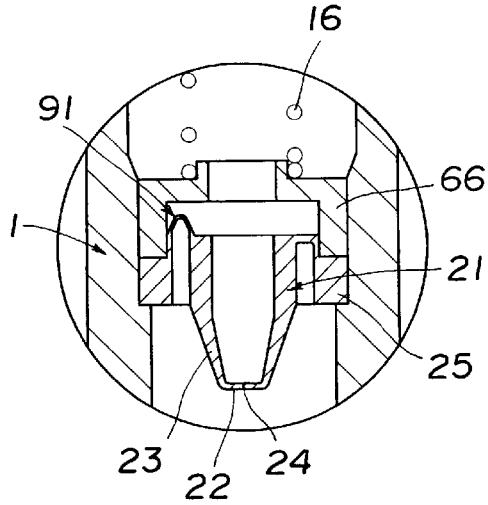
Figure 48:
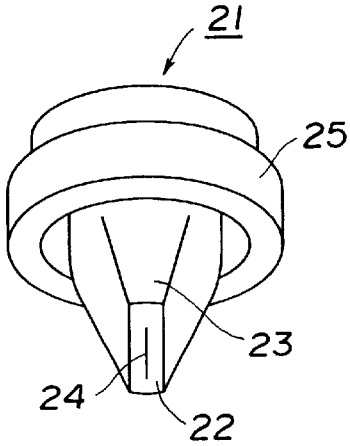
Figure 49:
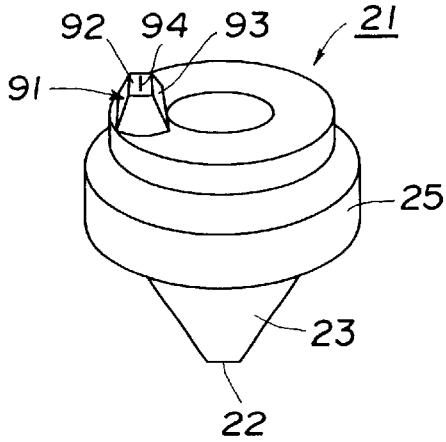
Figure 50:
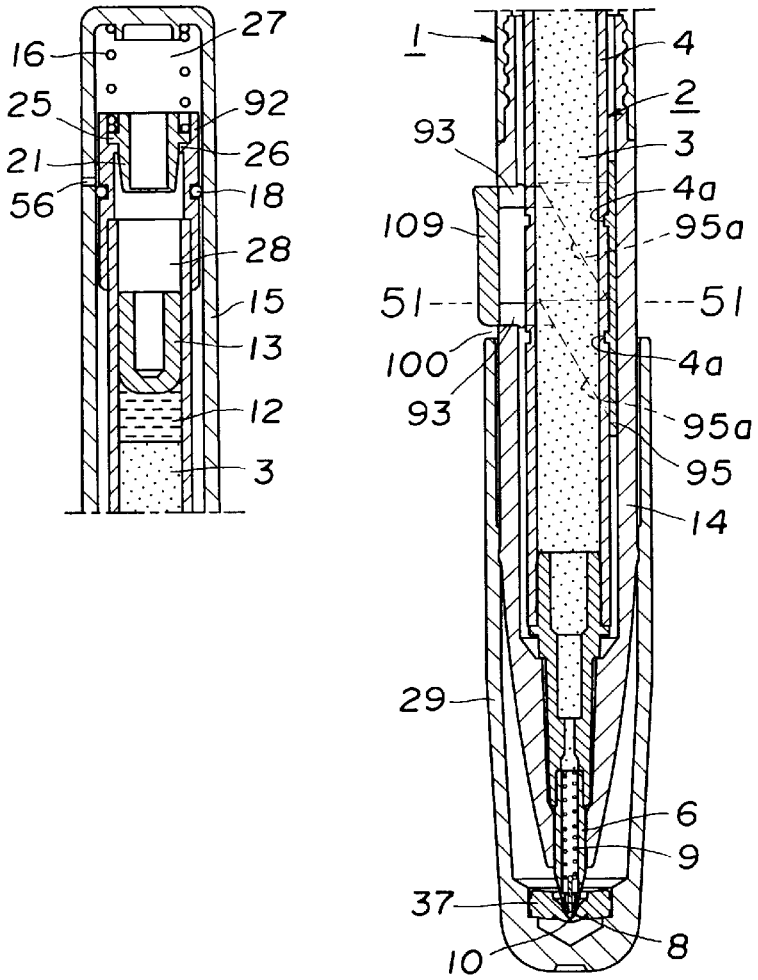
Figure 51:
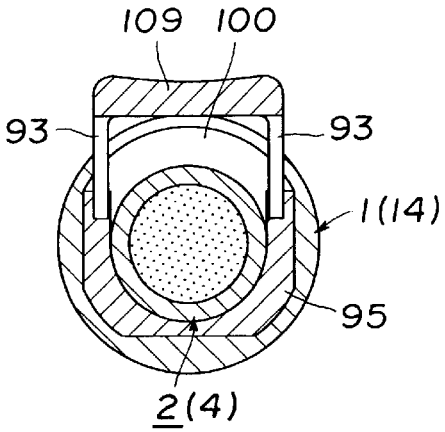

FIGS. 47 to 49 show a twelfth embodiment of the invention showing a modification of the valve mechanism 21 of the eleventh embodiment, and this embodiment will be explained with reference to also FIG. 43.

A first valve mechanism 21 which is located at a center of the valve mechanism of this embodiment has a cylindrical body 23 having a bottom portion 22 of reduced diameter and a slit 24 on the bottom portion 22. On the opposite side of the first valve mechanism 21 is provided a second valve mechanism 91 which has a tubular body 93 having a bottom portion 92 of reduced diameter. The bottom portion 92 is provided with a slit 94. As illustrated, the second valve mechanism 91 is smaller than the first valve mechanism 21 but their thickness is substantially constant. In other words, although the thickness is constant with each other, the second valve mechanism 91, because of its small size, is entirely harder and stiffer than the first valve mechanism 21. In other words, the slit 94 of the second valve mechanism 91 is not so easily opened as the slit 24 of the first valve mechanism 21.

The valve mechanisms 21 and 91 have cylindrical bodies 23, 93, respectively, having gradually reduced diameters so that the slits 24, 94 can be easily opened by a pressure from the cylindrical bodies but not easily opened by a pressure from the opposite side. The other features and structures are substantially similar with those of the previous embodiments.

An operation of the structure will be described. In an advancing process of the pushing member 55 (see FIG. 43), the O-ring 18 passes through the through hole 20 and at this moment the pressure chamber 27 starts its pressurization and when the pressure is elevated up to a certain point, the slit 24 of the first valve mechanism 21 is opened so that the compressed air is moved to the pressure holding chamber 28 and, therefore, the pressure in the pressure holding chamber is increased. Consequently, the float 13 is advanced together with the grease 12 to pressurize the liquid 3. Thus, it is not that the liquid is pressurized while it is in contact with the air but that the liquid is pressurizes while it is in contact with the float 13 and the grease 12. This is very important and effective particularly to the applicators using a hygienic liquid such as cosmetics and volatile material such as a correction liquid. In this structure, the slit 94 of the second valve mechanism 91 holds its closed position and no compressed air is introduced from the slit 94.

When the pushing force of the pushing member 19 is released, the slit 24 of the first valve mechanism 21 is opened so that the interior of the pressure chamber is placed temporarily into a decompressed state at a moment but when the O-ring 18 of the pushing member 19 reaches the longitudinal groove 20 of the tubular shaft body 1, the pressure chamber 27 is communicated with the exterior and, therefore, a fresh air is introduced into the pressure chamber 27 to overcome or cancel the decompressed condition. Even if the pressure chamber is temporarily placed into a decompressed condition, the second valve mechanism 91 which is formed smaller is not opened by such decompression.

When an excessive pressure is added to the pressure holding chamber 28, the slit 94 of the second valve mechanism 91 is opened to return the excessive pressure into the pressure chamber 27 and then the excessive pressure is discharged out of the longitudinal groove 20. In a non-use state of the applicator, when an inner pressure in the pressure holding chamber 28 is abruptly increased due to an abrupt elevation of temperature, the slit 94 of the second valve mechanism 91 is opened to reduce the excessive pressure.

In the previous embodiments of the invention, description has been made to the applicators of a rear-end knocking type in which the pushing member 19 and its synonym is positioned at the rear end of the tubular shaft body 1 so that the pushing member 19 is pushed (or knocked) into the shaft body 1 to provide a necessary operation. FIGS. 51 to 57 show a thirteenth embodiment of the invention wherein an element which corresponds to the pushing member 19 is provided on the side wall of the tubular shaft body 1 to form a side-knock type structure.

Figure 52:
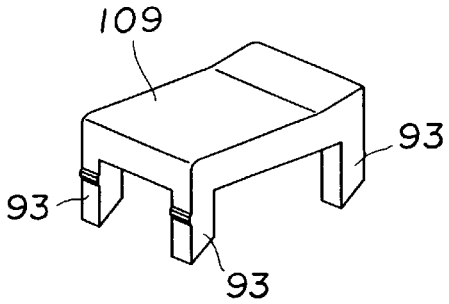
Figure 53:
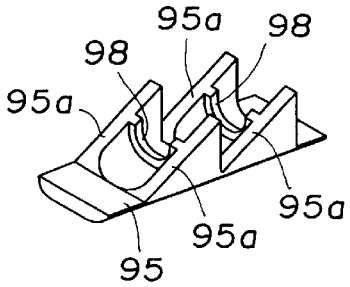
Figure 54:
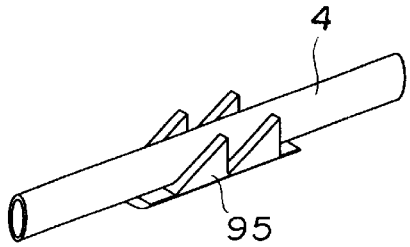
Figure 55:
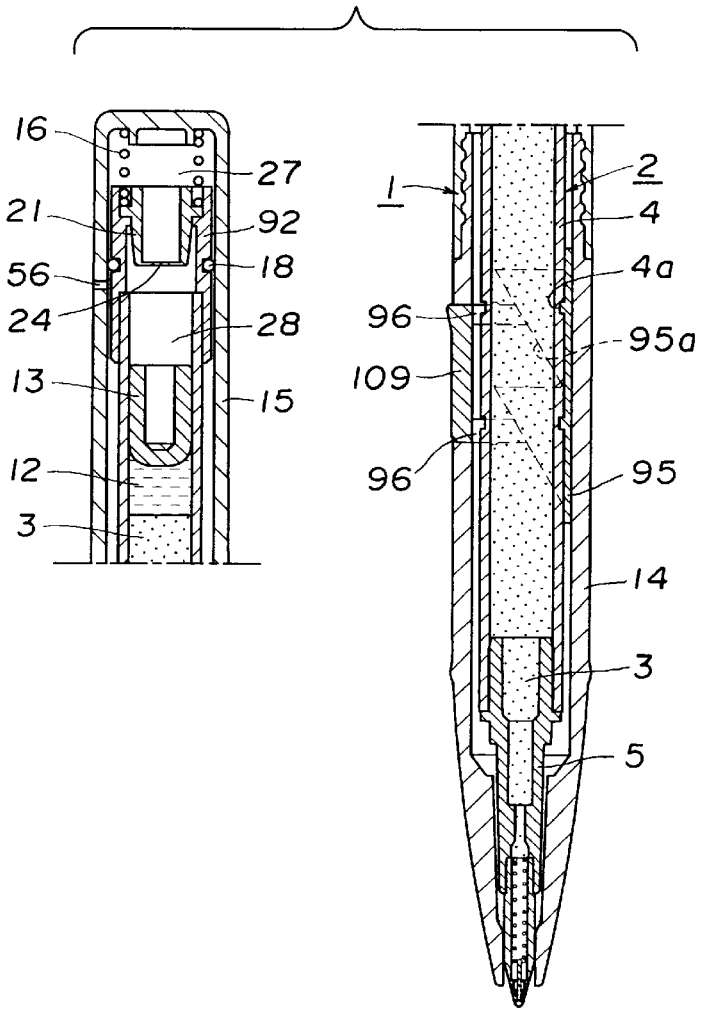

With reference to FIGS. 50 to 55, a window 100 is formed on the middle side wall portion of the front shaft 14, and a pushing member 109 is disposed so that it is displaceable in a radial direction. At the four corners of the pushing member 109, legs 93 are formed as shown in FIG. 52. The legs 93 have the lower ends which are contacted with an inclined surface 95*a* of a slider 95 fixed unitarily to the refill 2. The slider 95 have four inclined surfaces 95*a* as shown in FIG. 53. An engagement projection 98 is formed on an inner side of the inclined surface 95*a* so that the refill 2 (container tube 4) is unitarily fixed. Naturally, this engagement projection 98 is formed, in the form of recess 4*a*, on the outer surface of the middle portion of the container tube 4. As shown in FIG. 54, however, it is possible to form both the container tube 4 of the refill 2 and the slider 95 integrally by an injection molding method, for example. This will reduce the number of assembly and the number of molding dies. Reference numeral 29 represents a cap which has a gasket 37 to which the ball 8 is contacted.

A brief description will be made on the operation of this structure. When the pushing member 109 is pushed radially inwardly, the legs 93 are moved in the radial direction of the tubular shaft body 1 to urge the slider 95 in the rearward direction. By this, the refill 2 fixed to the slider 95 is retracted against a spring force of the resilient member 16.

Further, by the retraction of the refill 2, a tubular member 92 is also retracted and in this retracting process, the pressurization of the tubular member 92 starts. When the pressure in the pressure chamber 27 is elevated up to a certain point, the slit 24 of the valve mechanism 21 (see FIG. 6) is opened to permit the pressurized air to move into the pressure holding chamber 28, so that the pressure in the pressure holding chamber is increased. As a result, the float 13 is advanced together with the grease 12 to place the liquid 3 into a compressed state. When the pressure in the pressure chamber 27 becomes equal to the pressure of the pressure holding chamber, the slit 24 of the valve mechanism is closed.

When user's finger tip is detached from the pushing member 109 to release the pushing actuation, the refill 2 is retracted by the effect of a resilient force of the resilient member 16 and a recovery force of the air in the pressure chamber 27. At this moment, the pressure chamber 27 is decompressed so that the pressure holding chamber 28 could be decompressed. However, since the slit 24 of the valve mechanism 21 is closed, the pressure in the pressure holding chamber 28 is maintained.

As similar as the previous embodiments, in the returning process of the refill 2, when the O-ring 18 of the tubular member 92 reaches the through hole 56, the pressure chamber 27 is communicated with the exterior and, therefore, a fresh air is introduced into the pressure chamber 27 to thereby dissolve (or, cancel) the decompressed state. Since the valve mechanism 21 is made of a rubber-like elastic material, when an excessive pressure is added to the pressure holding chamber 28, the slit 24 of the valve mechanism is opened after the pushing member is recovered to return the excessive pressure to the pressure chamber 27 and discharge it out of the through hole 56.

Figure 56:
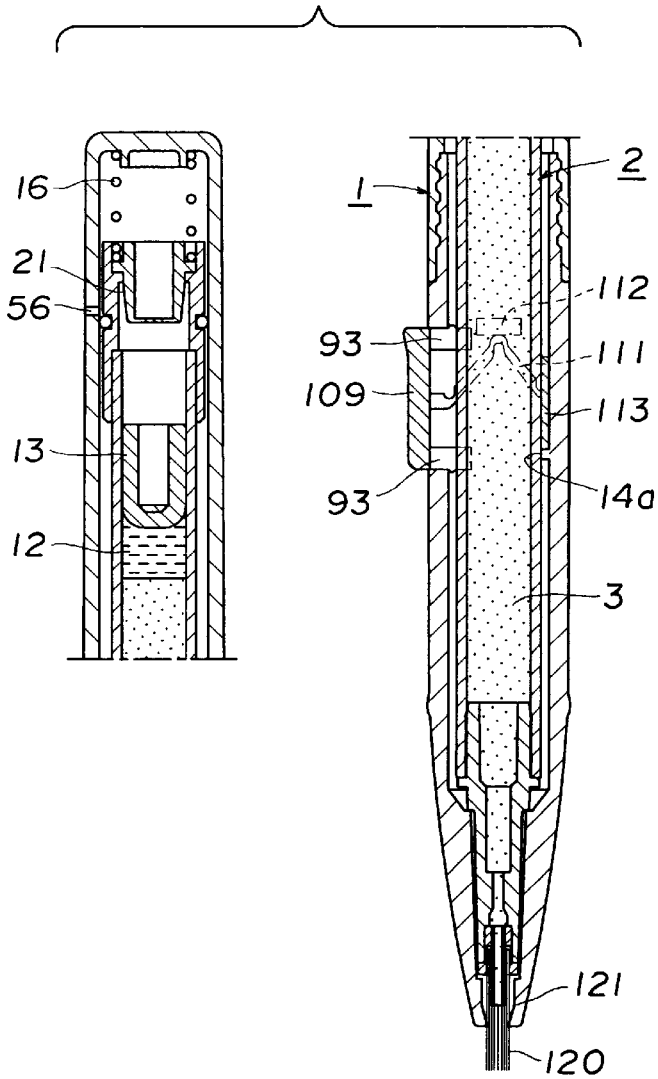
Figure 57:
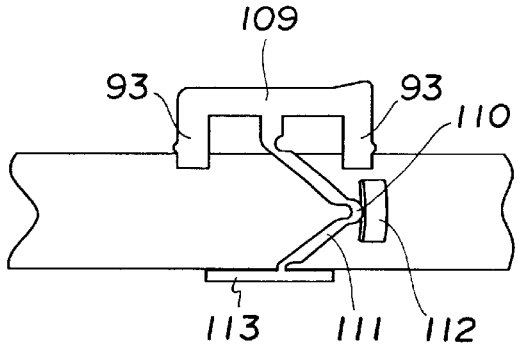

FIGS. 56 and 57 show fourteenth embodiment of the invention which is a modification of the thirteenth embodiment (FIGS. 50 to 54).

A pushing member 109 which is radially movable relative to a radial direction has short legs 93 at its four corners and a curved hinge portion 111 at the center of the side surface thereof. The hinge portion 111 has at its other end portion a control plate 113 which is engaged with an inner projection 14*a* in the front shaft 14. Further, a container tube 4 of the refill 2 has, on its side surface, a projection 112 to which a bent portion 110 of the hinge portion 111 is contacted.

In the illustration, a brush 120 of a fiber bundle is fitted to an end of the refill 2 instead of the ball 8 in the previous embodiments. This structure is useful for nail cleaners, correction pens. Since it is likely that foreign particles and dusts are unexpectedly adhered to the circumference of the brush 120, a circumferential projection 121 is formed on an inner surface of an opening portion 10 of the front shaft 14 so that the foreign particles and the like are scrubbed or scratched from the brush surface every time when refill 2 is moved back and forth.

In the operation of the modified structure described above, when the pushing member 109 is pushed radially inwardly, the hinge portion 111 is folded and the bent portion 110 is moved rearward, and the container tube 4 (refill 2) is pushed rearward by the bent portion 110. At this moment, pressurization (that is, compressive operation) of the pressure chamber 27 starts. Other actuation and operation will be substantially same as those of the thirteenth embodiment. When the pushing force to the pushing member 109 is released, the refill 2 is advanced by a spring force of the resilient member 16 and also the bent portion 111 is advanced by the projection 112 of the container tube 4 and, as a result, the pushing member 109 is lifted upward in the radial direction.

What is claimed is:

1. An applicator comprising: a tubular main shaft body containing therein a liquid; compressive means, disposed at a rear portion of the tubular main shaft body, for compressing the liquid; a non-return device positioned at a rear portion of the liquid and movable along with a decrease of the liquid; and a valve mechanism disposed between the non-return device and the compressive means, the valve mechanism having a cylindrical body formed of an elastic material, and the cylindrical body being tapered toward a front portion thereof.

2. An applicator according to claim 1; wherein the non-return device is made of a liquid material and a solid material.

3. An applicator according to claim 2; wherein the non-return device has a large-diameter portion and a small-diameter portion.

4. An applicator according to claim 1; further including a refill disposed in the tubular main shaft body, the refill having a liquid container tube containing therein the liquid, a tip holder press-fitted to a front portion of the liquid container tube, and a ball press-fitted to a front portion of the tip holder; and wherein the non-return device has two kinds of greases disposed at a rear end of the liquid in the liquid container tube to prevent the liquid from flowing out from a rear end of the liquid container tube, and a float made of a synthetic resin and disposed in the liquid container tube with a part of the float embedded in the greases.

5. An applicator according to claim 4; wherein the two kinds of greases include an aqueous grease and an oil grease.

6. An applicator according to claim 4; wherein the float has a small-diameter portion at a front portion thereof and a large-diameter portion at a rear portion thereof such that the small-diameter portion has a larger diameter than a minimum inner diameter of the tip holder.

7. An applicator comprising: a tubular main shaft body containing therein a liquid; compressive means, disposed at a rear portion of the tubular main shaft body, for compressing the liquid; a non-return device positioned at a rear portion of the liquid and movable along with a decrease of the liquid; and a valve mechanism disposed between the non-return device and the compressive means, the valve mechanism being spring-biased in a forward direction by a resilient member, and the movement of the valve mechanism in the forward direction being restricted by a step portion formed at a middle portion of the tubular main shaft body to define a forward stop position of the valve mechanism, whereby the valve mechanism is retractable from and returnable to the forward stop position.

8. An applicator according to claim 7; wherein the valve mechanism is formed of a rubber-like resilient material.

9. An applicator comprising:

a tubular main shaft body containing therein a liquid;

a pushing member, disposed at a rear portion of the tubular main shaft body, movable in a forward direction from a rest position for applying pressurized air into a chamber located in front of the pushing member to pressurize the liquid toward a tip of the applicator;

a non-return device positioned at a rear portion of the liquid and movable along with a decrease of liquid;

a valve mechanism, disposed between the non-return device and the pushing member, having a normally closed valve in communication with the chamber and openable by the force of the pressurized air to thereby apply the pressurized air to the non-return device;

wherein the tubular main shaft body has a groove which communicates the interior and exterior of the tubular main shaft body when the pushing member is in the rest position, and when the pushing member is moved in the forward direction by a pushing operation, the groove is closed by the pushing member.

10. An applicator according to claim 9; wherein a front air space is formed at a front portion of the valve mechanism and a rear air space is formed at a rear portion of the valve mechanism, the front air space communicating with the rear air space by a small through-hole.

11. An applicator comprising:

a tubular main shaft body containing therein a liquid;

a pushing member, disposed at a rear portion of the tubular main shaft body, movable in a forward direction from a rest position for applying pressurized air into a chamber located in front of the pushing member to pressurize the liquid toward a tip of the applicator;

a non-return device, positioned at a rear portion of the liquid and movable along with a decrease of the liquid, for preventing backflow of the liquid in the tubular main shaft body;

a valve mechanism, disposed between the non-return device and the pushing member, having a normally closed valve in communication with the chamber and openable by the force of the pressurized air to thereby apply the pressurized air to the non-return device;

a ball point pen tip fitted to the front portion of the tubular main shaft body; and a ball rotatably positioned at a front end of the ball point pen tip and spring-biased forwardly by a resilient member;

wherein the tubular main shaft body has a groove which communicates the interior and exterior of the tubular main shaft body when the pushing member is in the rest position, and when the pushing member is moved in the forward direction by a pushing operation, the groove is closed by the pushing member.

12. An applicator according to claim 11; wherein the non-return device has a liquid portion and a solid portion with the solid portion partly embedded in the liquid portion.

13. An applicator comprising:

a tubular main shaft body containing therein a liquid;

a pushing member, disposed at a rear portion of the tubular main shaft body, movable in a forward direction from a rest position for applying pressurized air into a chamber located in front of the pushing member to pressurize the liquid toward a tip of the applicator;

a non-return device, positioned at a rear portion of the liquid and movable along with a decrease of the liquid, for preventing an backflow of the liquid in the tubular main shaft body;

a valve mechanism, disposed between the non-return device and the pushing member, having a normally closed valve in communication with the chamber and openable by the force of the pressurized air to thereby apply the pressurized air to the non-return device;

a tip holder press-fitted to a front portion of the tubular main shaft body;

a ball point pen tip fitted to the front portion of the tip holder; and a ball rotatably positioned at a front end of the ball point pen tip and spring-biased forwardly by a resilient member;

wherein the tubular main shaft body has a groove which communicates the interior and exterior of the tubular main shaft body and when the pushing member is moved in the forward direction by a pushing operation, the groove is closed by the pushing member.

14. An applicator according to claim 13; wherein the non-return device has a liquid portion and a solid portion with the solid portion partly embedded in the liquid portion.

15. An applicator comprising: a tubular body containing therein a liquid and having at a front end thereof a tip for dispensing the liquid; a non-return device movably disposed in the tubular body rearwardly of and in contact with the liquid for preventing backflow of the liquid in a rearward direction; manually-movable piston member movable in the tubular body, during use to dispense the liquid, in a forward direction for pressurizing air admitted into a chamber located in front of the piston member; and a normally closed valve spaced from the piston member and in communication with the chamber and openable by the force of the pressurized air to apply the pressurized air to the non-return device to urge the non-return device forwardly to thereby pressurize the liquid.

16. An applicator according to claim 15, further including a ball rotatably disposed at a front end of the tip of the applicator.

17. An applicator according to claim 16; wherein the applicator is a ball point pen.

18. An applicator according to claim 15; wherein the non-return device comprises one or more kinds of greases, and a float having a front portion embedded in the one or more kinds of greases and a rear portion to which is applied the pressurized air.

19. An applicator according to claim 18; further including a ball rotatably disposed at a front end of the tip of the applicator.

20. An applicator according to claim 19; wherein the applicator is a ball point pen.

21. An applicator according to claim 15; wherein the applicator is a ball point pen and has a ball rotatably disposed at a front end of the applicator tip.

22. An applicator according to claim 15; further including a resilient member for normally urging the piston member rearwardly to a rear stop position; and an air passage communicating the chamber with the exterior of the applicator when the piston member is in the rear stop position, the air passage being blocked by the piston member during movement thereof in the forward direction.

23. An applicator according to claim 22; wherein the air passage comprises at least one groove extending lengthwise in the tubular body along the path of displacement of the piston member.

24. An applicator according to claim 15; wherein the valve is comprised of elastic material and tapers toward a front portion thereof, the tapered front portion of the valve being normally closed and being opened by the force of the pressurized air in the chamber.

* * * * *